US012628861B2

(12) United States Patent
Morrison et al.

(10) Patent No.: US 12,628,861 B2
(45) Date of Patent: May 19, 2026

(54) LIQUID FORMULATIONS FOR ORAL FLAVORED PRODUCT

(71) Applicant: Intrepid Brands, LLC, Louisville, KY (US)

(72) Inventors: John Morrison, Louisville, KY (US); Brendan McDermott, Santa Monica, CA (US); Trent Grantz, Louisville, KY (US); Rob Riesel, Louisville, KY (US)

(73) Assignee: INTREPID BRANDS, LLC, Louisville, KY (US)

( * ) Notice: Subject to any disclaimer, the term of this patent is extended or adjusted under 35 U.S.C. 154(b) by 470 days.

(21) Appl. No.: 18/303,293

(22) Filed: Apr. 19, 2023

(65) Prior Publication Data

US 2023/0329318 A1 Oct. 19, 2023

Related U.S. Application Data

(60) Provisional application No. 63/332,496, filed on Apr. 19, 2022.

(51) Int. Cl.
*A24B 15/167* (2020.01)

(52) U.S. Cl.
CPC ..... *A24B 15/167* (2016.11)

(58) Field of Classification Search
None
See application file for complete search history.

(56) References Cited

U.S. PATENT DOCUMENTS

| | | | |
|---|---|---|---|
| 9,185,931 | B2 | 11/2015 | Gao et al. |
| 9,420,827 | B2 | 8/2016 | Mishra et al. |
| 9,521,864 | B2 | 12/2016 | Gao et al. |
| 10,183,016 | B2 | 1/2019 | Gao et al. |
| 10,349,672 | B2 | 7/2019 | Gao et al. |
| 2005/0260264 | A1 | 11/2005 | Edgren et al. |

(Continued)

OTHER PUBLICATIONS

What Is Vegetable Glycerin? Uses, Benefits and Side Effects, 2023, healthlijne, [online], retrieved from the Internet, [retrieved Aug. 27, 2025], URL:https://www.healthline.com/nutrition/vegetable-glycerin. (Year: 2023).*

(Continued)

*Primary Examiner* — Dennis R Cordray
(74) *Attorney, Agent, or Firm* — Stites & Harbison, PLLC; Terry L. Wright

(57) ABSTRACT

Liquid formulations for use in an oral product include about 85% w/w to about 95% w/w of a carrier liquid; about 1% w/w to about 5% w/w of a flavoring agent; about 1% w/w to about 2% w/w of an active ingredient; and about 0.5% w/w to about 3.5% w/w of a sweetener. Oral products are further provided and comprise about 25% w/w to about 30% w/w of a fibrous substrate; about 50% w/w to about 70% w/w of a carrier liquid; about 1% w/w to about 5% w/w of a flavoring agent; about 0.5% w/w to about 2% w/w of an active ingredient; and about 0.1% w/w to about 3.5% w/w of a sweetener. Methods of making an oral product are also provided and comprise the steps of providing an exemplary liquid formulation, and then combining the liquid formulation with a fibrous substrate.

17 Claims, 15 Drawing Sheets

(56) References Cited

U.S. PATENT DOCUMENTS

| | | | | |
|---|---|---|---|---|
| 2014/0332013 | A1* | 11/2014 | Gao | B29C 48/0011 131/111 |
| 2016/0354360 | A1 | 12/2016 | Gao et al. | |
| 2020/0246404 | A1* | 8/2020 | Yucel | A61K 31/05 |
| 2021/0169788 | A1 | 6/2021 | Mua et al. | |
| 2021/0251277 | A1 | 8/2021 | McDermott et al. | |

OTHER PUBLICATIONS

United States Patent and Trademark Office, International Search Report and Written Opinion issued in corresponding Application No. PCT/US2023/065953, mailed Sep. 1, 2023.

* cited by examiner

LIQUID FORMULATIONS FOR ORAL FLAVORED PRODUCT

RELATED APPLICATIONS

This application claims priority from U.S. Provisional Application Ser. No. 63/332,496, filed Apr. 19, 2022, the entire disclosure of which is incorporated herein by this reference.

TECHNICAL FIELD

The presently-disclosed subject matter generally relates to liquid formulations for use in producing an oral flavored product. In particular, certain embodiments of the presently-disclosed subject matter relate to liquid formulations for use in producing an oral flavored product where nicotine and/or other active ingredients are included in the liquid formulation for subsequent delivery to a user via sub labial uptake or by other oral routes.

BACKGROUND

Herbal materials, such as tobacco and hemp, have been enjoyed by individuals for many years and in a variety of different forms. Traditionally, tobacco and hemp were enjoyed in a combustible form in which users smoked (e.g., via cigarette or cigar) the tobacco or hemp to allow for the delivery of nicotine and/or other active agents in those products. Chewing tobacco and other non-combustible forms of those products have also been enjoyed over the years. More recently, however, innovations have included heat-not-burn products that require energy and peripherals to enable tobacco consumption at below combustion levels. Additionally, in recent years, synthetic products have risen in popularity as a means to orally deliver nicotine and other active ingredients in a smokeless manner.

To date, these synthetic products have taken the form of, for example, cellulose fiber and nicotine mixtures that are combined with one or more binders and molded to form an oral product or, as another example, absorbent pods that are comprised of a pouch made of a porous material. In each of these products, however, issues such as stability, moisture retention, and manufacturing requirements have reduced the ability to provide a consistent flavor and release of active agent by the product. Accordingly, formulations capable of use in an oral flavored product and in a manner that not only provides consistent flavor and active agent release, but that allows for ease of manufacturing would be both highly desirable and beneficial.

SUMMARY

Figure 1A:
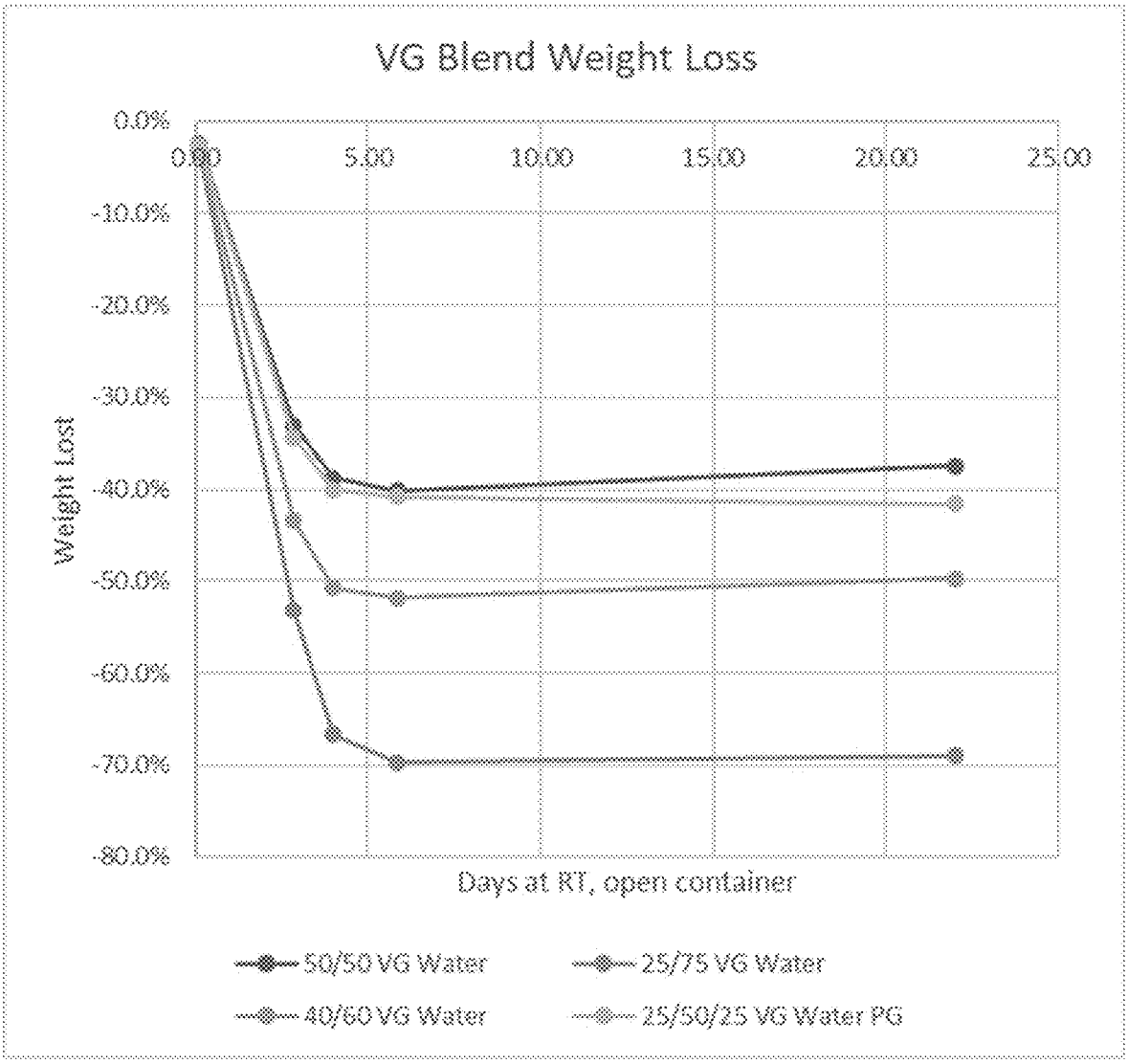
FIGS. 1A-1B include graphs showing liquid volatile retention over time.

The presently-disclosed subject matter meets some or all of the above-identified needs, as will become evident to those of ordinary skill in the art after a study of information provided in this document.

This summary describes several embodiments of the presently-disclosed subject matter, and in many cases lists variations and permutations of these embodiments. This summary is merely exemplary of the numerous and varied embodiments. Mention of one or more representative features of a given embodiment is likewise exemplary. Such an embodiment can typically exist with or without the feature (s) mentioned; likewise, those features can be applied to other embodiments of the presently-disclosed subject matter, whether listed in this summary or not. To avoid excessive repetition, this summary does not list or suggest all possible combinations of such features.

The presently-disclosed subject matter includes liquid formulations for use in producing an oral flavored product. In particular, certain embodiments of the presently-disclosed subject matter include liquid formulations for use in producing an oral flavored product where nicotine and/or other active ingredients are included in the liquid formulation for subsequent delivery to a user via sub labial uptake or by other oral routes.

In some embodiments, a liquid formulation for use in an oral product, comprises about 85% w/w to about 95% w/w of a carrier liquid; about 1% w/w to about 5% w/w of a flavoring agent; about 1% w/w to about 2% w/w of an active ingredient; and about 0.5% w/w to about 3.5% w/w of a sweetener. In some embodiments, the active ingredient comprises nicotine. In some embodiments, the formulations further comprise about 1% w/w to about 6% w/w of a binding agent. In some embodiments, the sweetener comprises sucralose or saccharine.

With regard to the carrier liquids used in accordance with the presently-disclosed subject matter, in some embodiments, the carrier liquid is selected from the group consisting of propylene glycol, vegetable glycerin, water, and combinations thereof. In some embodiments, the carrier liquid comprises about 50% w/w of propylene glycol, about 35% w/w of vegetable glycerin, and about 10% w/w water.

In further embodiments of the presently-disclosed subject matter are oral products including and making use of the liquid formulations described herein. In some embodiments, an oral product is provided that comprises about 25% w/w to about 30% w/w of a fibrous substrate; about 50% w/w to about 70% w/w of a carrier liquid; about 1% w/w to about 5% w/w of a flavoring agent; about 0.5% w/w to about 2% w/w of an active ingredient; and about 0.1% w/w to about 3.5% w/w of a sweetener. In some embodiments of the oral products, the active ingredient comprises nicotine that, in certain embodiments, when combined with the fibrous substrate and other materials included in the oral product is included in the formulation in an amount of about 0.5% w/w to about 1% w/w. In some embodiments, the oral products further comprising about 0.5% w/w to about 6% w/w of a binding agent. In some embodiments of the oral products, the sweetener comprises sucralose or saccharine.

Similar to the liquid formulations described herein, in some embodiments of the presently-described oral products, the carrier liquid included in the oral product is selected from the group consisting of propylene glycol, vegetable glycerin, water, and combinations thereof. In some embodiments, when combined with the fibrous substrate and other materials included in the oral product, the carrier liquid comprises about 30% w/w to about 50% w/w of propylene glycol, about 15% w/w to about 30% w/w of vegetable glycerin, and about 5% w/w to about 10% w/w water.

With regard to the fibrous substrates used in the exemplary oral products of the presently-disclosed subject matter, in some embodiments, the fibrous substrate is comprised of a synthetic polymer. For instance, in certain embodiments, such a synthetic polymer is polyester. In some embodiments that make use of a polyester fibrous substrate, an oral product of the presently-disclosed subject matter is provided that comprises: about 36% w/w propylene glycol; about 27% w/w of a polyester fibrous substrate; about 27% w/w vegetable glycerin; about 7% w/w water; about 1% w/w to about 2% w/w of a flavoring agent; about 1% w/w triacetin; about 1% w/w nicotine; and about 0.5% sucralose. In other embodiments, the oral product comprises: about 34% w/w propylene glycol; about 27% w/w of a polyester fibrous substrate; about 27% w/w vegetable glycerin; about 7% w/w water; about 1% w/w to about 2% w/w of a flavoring agent; about 2% w/w sorbitol; about 1% w/w nicotine; and about 0.5% saccharine.

Further provided, in some embodiments of the presently-disclosed subject matter, are methods of making an oral product. In some embodiments, a method of making an oral product is provided that comprises an initial step of providing a liquid formulation including about 85% w/w to about 95% w/w of a carrier liquid, about 1% w/w to about 5% w/w of a flavoring agent, about 1% w/w to about 2% w/w of an active ingredient, and about 0.5% w/w to about 3.5% w/w of a sweetener. The liquid formulation is then combined with a fibrous substrate and, in certain embodiments, such a step of combining the liquid formulation with the fibrous substrate comprises sorbing the liquid formulation onto the fibrous substrate. In some embodiments, the liquid formulation further includes about 1% w/w to about 6% w/w of a binding agent.

Further features and advantages of the present invention will become evident to those of ordinary skill in the art after a study of the description, figures, and non-limiting examples in this document.

DESCRIPTION OF EXEMPLARY EMBODIMENTS

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

While the terms used herein are believed to be well understood by those of ordinary skill in the art, certain definitions are set forth to facilitate explanation of the presently-disclosed subject matter.

Unless defined otherwise, all technical and scientific terms used herein have the same meaning as is commonly understood by one of skill in the art to which the invention(s) belong.

Where reference is made to a URL or other such identifier or address, it understood that such identifiers can change and particular information on the internet can come and go, but equivalent information can be found by searching the internet. Reference thereto evidences the availability and public dissemination of such information.

Although any methods, devices, and materials similar or equivalent to those described herein can be used in the practice or testing of the presently-disclosed subject matter, representative methods, devices, and materials are described herein.

The present application can "comprise" (open ended), "consist of" (closed ended), or "consist essentially of" the components of the present invention as well as other ingredients or elements described herein. As used herein, "comprising" is open ended and means the elements recited, or their equivalent in structure or function, plus any other element or elements which are not recited. The terms "having" and "including" are also to be construed as open ended unless the context suggests otherwise.

Following long-standing patent law convention, the terms "a", "an", and "the" refer to "one or more" when used in this application, including the claims. Thus, for example, reference to "a cell" includes a plurality of such cells, and so forth.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, "optional" or "optionally" means that the subsequently described event or circumstance does or does not occur and that the description includes instances where said event or circumstance occurs and instances where it does not. For example, an optional ingredient means that the ingredient can be included or cannot.

The presently-disclosed subject matter includes liquid formulations for use in producing an oral flavored product. In particular, certain embodiments of the presently-disclosed subject matter include liquid formulations for use in producing an oral flavored product where the nicotine and/or other active ingredients in the liquid formulations are delivered via sub labial uptake or by other oral routes.

In some embodiments of the presently-disclosed subject matter, a liquid formulation for use in an oral product is provided that comprises: about 1% w/w to about 2% w/w of an active ingredient; about 85% w/w to about 95% w/w of a carrier liquid; about 1% w/w to about 5% w/w of a flavoring agent; and about 0.5% w/w to about 3.5% w/w of a sweetener. In some embodiments, by making use of the foregoing components of the liquid formulations in the recited percentages, the liquid formulation allows for an oral product to be produced that provides consistent flavor and active agent release and that allows ease of manufacturing in a consistent and reproducible manner, as further described in detail below. Further, by making use of the liquid formulations described herein, the amount of active ingredient, such as the nicotine level, included in the product is applied more consistently across the product and an amount of active ingredient can be selected by the user and then supplied to the user as desired.

In some embodiments, the active ingredient included in the liquid formulation is a synthetic freebase nicotine solution. Of course, the active ingredient is not limited to the use of such nicotine alone. Other alternative active ingredients can also or alternatively be included in a liquid formulation of the presently-disclosed subject matter and can include, but are not limited to, any type of nicotine whether it is synthetic or tobacco derived, a nicotine salt, disassociate freebase nicotine, nicotine polacrilex, or the like. Additional non-nicotine active ingredients that can be included in an exemplary product include, but are also not limited to, other herbal or synthetic products, cannabinoid and cannabinoid extracts, caffeine, melatonin, cytosine, kava, and kratom (*Mitragyna speciosa*) if legal in the local jurisdiction. Further active ingredients capable of being included in a liquid formulation include dietary and nutritional supplements for uptake either sublabially or through the digestive system. For example, such other active ingredients can include minerals, amino acids, vitamins (A, C, D, B12) or similar compounds. In yet further embodiments, the active ingredient can be terpenoids, oils or other extracts of plant matter, such as hemp, tobacco, Goldenrod Herb *Lobelia* (*Lobelia inflata*). In some embodiments, the oral products described herein can also be adapted to include prescription or over-the-counter ingredients that, when used as directed by a physician, can allow the user to tailor their intake to their needs. Examples of such embodiments could include antidepressants, such as bupropion, or smoking cessation products, such as varenicline. Similar embodiments can include over the counter numbing agents or other topical painkillers for mouth or tooth pain or for treating a sore throat.

Regardless of the particular active ingredient included in an exemplary formulation, the liquid formulations described herein for use in an oral product generally include the active ingredients in a carrier liquid that aids in loading and suffusing the active ingredients and other additives onto the substrate of the oral product during the manufacturing process, as described in further detail below. Such carrier liquids can also aid in distribution of the active ingredient into the end user's saliva. In some embodiments, the carrier liquids included in an exemplary liquid formulation include water, propylene glycol, vegetable glycerin, oils such as coconut oil or medium-chain triglycerides (MCT oil), or other similar carriers. In some embodiments, it is further contemplated that the carrier liquid used to apply the active ingredients to the substrate of the oral product can be removed or dried, for example by heating, upon application of the liquid formulation. In these examples, the dried substrate in turn includes a solid crystalline substance that, when the oral product encounters the end user's saliva, comes back into contact with a primary source of water for subsequent delivery to the user. In such embodiments, as there is no solution included in the oral product utilized by the user, the active ingredients or other additives included in the exemplary formulation are typically adapted to the saliva dissolution environment, particularly the pH of the resultant saliva mixture.

With the foregoing in mind, the term "carrier liquid" is, in some embodiments, used interchangeably with the term "solvent" or "thinning agent" whereby, depending on the choice of a particular active ingredient, water or other solvents are used to thin active ingredients and spread them evenly across the substrate. Examples of non-water based solvents that can be used in this regard include, but are not limited to, vegetable glycerin and propylene glycol. Of course, a solvent in a specific example can be selected based its ability to dissolve the active ingredient, or any other solids, being added to an exemplary product. In some embodiments, the carrier liquid is selected from the group consisting of propylene glycol, vegetable glycerin, water, and combinations thereof. In some embodiments, the carrier liquid comprises about 50% w/w of propylene glycol, about 35% w/w of vegetable glycerin, and about 10% w/w water. In some embodiments that make use of propylene glycol and vegetable glycerin, the ratio of propylene glycol to vegetable glycerin is about 1.2 to about 1.4, such as, in some embodiments, a ratio of about 1.25 to about 1.3.

By making use of the liquid formulations of the presently-disclosed subject matter, the liquid formulations generally provide the active ingredients in a form that avoids disrupting the overall intended texture of the produced oral product.

In most embodiments, the oral product is intended to be soft and resilient, fitting comfortably next to the user's gums. In some cases, however, the active ingredients or other additives included in an exemplary liquid formulation will have a texture that interferes with the desired texture of the produced oral product. To correct this, in some embodiments, other additives can also be included in a liquid formulation of the presently-disclosed subject matter, such as binding agents or texture adjusters. In some embodiments, no changes to the substrate have to be made, and instead binding agents can be selected to help aid in bonding the active ingredient to the substrate. Such binding agents can also include smoothing agents, such as gum acacia, to adjust the harshness of taste or texture. In some embodiments, about 0.5% w/w to about 6% w/w of a binding agent is included in an exemplary formulation.

In some embodiments of the liquid formulations described herein, such binding agents can also be used to modify the flavor release pattern of the active ingredients by, for example, thickening the carrier solution. In this way, the active ingredient is more tightly or more strongly bound in solution or directly to the substrate and requires more time to release into saliva. Of course, other texture adjustments can include additional solvents or moisture to thin the solution or accelerate flavor release and can be selected for a particular application without departing from the spirit and scope of the subject matter described herein.

In some embodiments, and again depending on the active ingredient, the pH of the solution may need to be altered for chemical stability, on the shelf, or bioavailability, in the mouth, for example. As the products described herein are meant for oral use, the effect on pH levels of saliva can be considered as well. For example, nicotine is a weak base and user uptake of nicotine is often dependent on pH level. Examples of pH control agents that can be included as other additives include sodium hydroxide, potassium carbonate, calcium carbonate, sodium bicarbonate, and other carbonates, and similar food-grade acidic and alkaline substances to alter the pH of the product and product-salvia mixture.

In addition to the above-described ingredients, the liquid formulations included and described for use in an oral product in accordance with the presently-disclosed subject matter can include any number of flavorings and sweeteners as other additives to provide a desired flavor for marketability, product differentiation, and overall taste. As with other additives, such flavorings can be added to the liquid formulation in powdered form or can be added as a liquid or suspended in solution. Exemplary flavorings that can be utilized include, but are not limited to, terpenes (natural or synthetic), extracts, concentrates, organic acids, flavor enhancers, salt, and any other similar material. In some embodiments, sweeteners are added as or in addition to flavorings. Some sweeteners can also work as binding agents and textural adjustment agents. For example, sweeteners could include polydextrose, honey, syrups, simple & complex sugars, polysaccharides, sorbitol, sugar alcohols, and other similar sweet tasting compounds. In some embodiments, the sweetener comprises sucralose or saccharine.

To produce an exemplary oral product that makes use of the liquid formulations described herein, in some embodiments, the presently-described liquid formulations are particularly suited for use with a fibrous substrate, whereby the liquid formulations can be applied to (e.g., mixed directly with the fibrous substrates). In some embodiments, such a fibrous substrate can be formed or remain in a natural form similar to a ball, while, in other embodiments, the fibrous substrate can be in the form of a loose fiber, pellets, roll, sponge, woven fiber, ball, granular, foam, dry ball, filled pellet, or the like. For example, in some embodiments, the substrate is in a ball form that is visually appealing and comfortable in use. As another example, in some embodiments where the substrate is a fiber, it can be woven into a fabric capable of being provided in a rolled form for more compact packaging. In such embodiments, the substrate fabric can be manufactured in a continuous process and any carrier liquid/liquid formulation can be applied to increased consistency and, with high, controllable accuracy depending on manufacturing methods.

With further regard to the fibrous substrates capable of use in accordance with the presently-disclosed subject matter, in some embodiments, the fibrous substrate is chopped up, blended or pulled apart cotton. In other embodiments, synthetic cotton, polyester fibers, or other suitable material are utilized. In one embodiment, the substrate is a pelletized synthetic fiber, where the pellet can be formed from polyester strands or fibers. In some embodiments, other synthetic fibers capable of being used in accordance with the present invention include polypropylene, polyethylene, kevlar, rayons, synthetic fibers, acrylic, spandex, nylon, elastane, polyolefin, or other similar synthetic polymers. In some embodiments, such synthetic fibers also present advantages in allowing for a desired strength, durability, resiliency and flexibility profile and, in turn, allowing the oral product to be produced in a manner that adjusts the sensation (mouthfeel) and compression when the oral product is placed in the end-user's mouth. In some embodiments, certain synthetic materials are selected to allow for advantages in non-toxicity, lack of reactivity, and UV resistance.

In some embodiments, and as indicated above, polyester is used as a material for the fibrous substrate based on its non-toxicity and thermoplasticity. The nature of the material allows for cross linking among the polyester fibers, which, in turn, can be used to increase pellet resiliency or adjust mouthfeel. When compared to a natural fiber, the polyester is cleaner and less likely to grow organisms and is non-toxic if accidentally swallowed by the end user.

As another advantage to the use of polyester fibers with the liquid formulations of the presently-disclosed subject matter, in some embodiments, the individual fibers forming the pellet of the polyester substrate have a series of individual pores. In such embodiments, it is appreciated that because the polyester fibers in such an exemplary oral product are a synthetic polymer, little to no absorption of the active ingredient takes place where the active ingredient would enter into the interstitial space within the substrate. Adsorption, on the other hand, is a weak bonding of to the surface by Van Der Walls forces where the electrokinetic potential of a surface is measured by its zeta potential which varies by pH. Zeta potential of the substrate can be varied by ionization of the ingredients in the fluid and modifications to the surface. While many synthetic fibers are relatively inert chemically, potential modifications of the substrate are still available include heating and cooling the material at varying rate, oxidization of polydopamine and other similar surface coatings, subjecting the substrate to high or low pressures, plasma treatments, or other similar polymer modification treatments. Additionally, inclusions and additives, like carbon or silicon, can be added to the substrate before it is formed into fibers to increase resilience, fiber strength, or other properties. In some cases, these additives may be temporary melting out of the substrate to provide internal or external porosity or otherwise vary surface texture. In this way, by providing a synthetic fiber having increased porosity and because adsorption requires a surface to cling to, the increase in total surface area provided by the pores in an individual fiber further allow for the adsorption of the active ingredients while also increasing the surface area of the fibers themselves.

In some embodiments, the densely packed pellet substrate formed by the fibers further increases the available surface area and adsorption capacity. Fiber packing density does have the effect of inhibiting fluid flow within the pellet and while this may lead to some difficulties in the speed of loading the pellet with the liquid formulation and active ingredient, it has offsetting advantages in extending and controlling release of the active ingredient. The user's saliva cannot flow freely into the core of the pellet during use, and thus, slow release of the active ingredient is achieved by altering the density and proximity of the fibers. Certain thermoplastic polymers present other advantages in this regard because they can be formed and reformed using carefully directed heat.

In some embodiments of the presently-disclosed subject matter that make use of a fibrous substrate, and with the foregoing principles in mind, an oral product is provided that comprises: about 25% w/w to about 30% w/w of a fibrous substrate; about 50% w/w to about 70% w/w of a carrier liquid; about 1% w/w to about 5% w/w of a flavoring agent; about 0.5% w/w to about 2% w/w of an active ingredient; and about 0.1% w/w to about 3.5% w/w of a sweetener. In some embodiments, the carrier liquid comprises about 30% w/w to about 50% w/w of propylene glycol, about 15% w/w to about 30% w/w of vegetable glycerin, and about 5% w/w to about 10% w/w water. In some embodiments, the active ingredient comprises nicotine that, in certain embodiments, is included in the formulation in an amount of about 0.5% w/w to about 1% w/w.

As one example of an oral product made in accordance with the presently-disclosed subject matter, in some embodiments, an oral product is provided where the oral product comprises: about 36% w/w propylene glycol; about 27% w/w of a polyester fibrous substrate; about 27% w/w vegetable glycerin; about 7% w/w water; about 1% w/w to about 2% w/w of a flavoring agent; about 1% w/w triacetin; about 1% w/w nicotine; and about 0.5% sucralose.

As another example of an oral product made in accordance with the presently-disclosed subject matter, in some embodiments, an oral product is provided where the oral product comprises: about 34% w/w propylene glycol; about 27% w/w of a polyester fibrous substrate; about 27% w/w vegetable glycerin; about 7% w/w water; about 1% w/w to about 2% w/w of a flavoring agent; about 2% w/w sorbitol; about 1% w/w nicotine; and about 0.5% saccharine.

Further provided, in some embodiments of the presently-disclosed subject matter, are methods of making an oral product. In some embodiments, a method of making an oral product is provided that includes an initial step of providing a liquid formulation having about 85% w/w to about 95% w/w of a carrier liquid, about 1% w/w to about 5% w/w of a flavoring agent, about 1% w/w to about 2% w/w of an active ingredient, and about 0.5% w/w to about 3.5% w/w of a sweetener. The liquid formulation is then subsequently combined with a fibrous substrate. In some embodiments, the step of combining the liquid formulation with the fibrous substrate comprises sorbing the liquid formulation onto the fibrous substrate.

Figure 2:
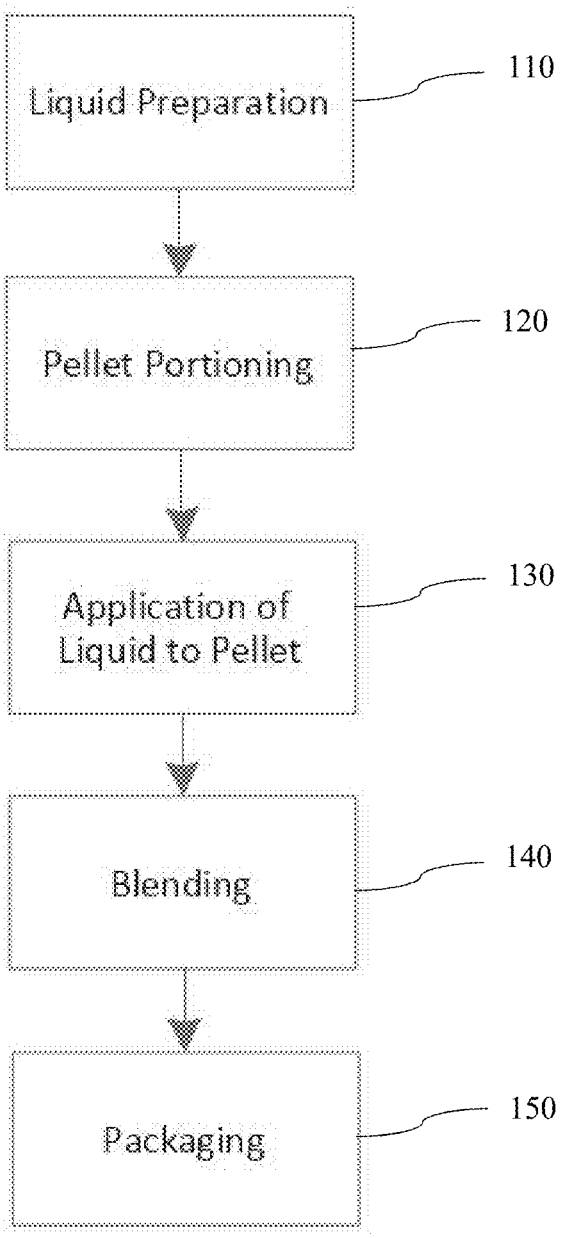
FIG. 2 is a flowchart showing an exemplary method of making an oral product in accordance with the presently-disclosed subject matter.

As one example of a method of making an oral product in accordance with the presently-disclosed subject matter, and referring now to FIG. 2, in some embodiments, a method of making an oral product is provided that includes an initial step 110 of preparing a liquid formation as described herein. A portion of a fibrous substrate in the form of a pellet is then provided, as indicated by step 120, and the liquid is applied to the pellets, as indicated by step 130. The pellets are then blended together as indicated by step 140, and are subsequently packaged, as indicated by step 150.

With further respect to the above-described methods, it is contemplated that variations on the above-described methods are also within the scope of the presently-disclosed subject matter and can be dependent on whether a portion of pellets (i.e., a fibrous substrate) is selected after application of the liquid formulation to the pellets or whether a portion of dry pellets is first selected and is then followed by application of a regulated amount of a liquid formulation. For instance, in certain embodiments and as an example of applying the liquid formulation to the pellets prior to selecting a portion of the pellets, a thin layer of pellets can be passed through a fluid curtain to saturate individual pellets and then the soaked materials can then be subjected to a centrifugal force in manner to control liquid retention amount to within product requirements. In other embodiments and as an example of applying the liquid formulation to the pellets after a portion of pellets is selected, pellets can be placed in a packaging container and a fluid application head can then be used to dose dry pellets with a regulated amount of liquid suitable for finished product. This can be done using application techniques comprised of, but are not limited to, compression, close contact, centrally applied followed by application of centrifugal force to distribute, multiple liquid distribution ports, porous media comprised of ceramic, stainless steel or plastic manufacture utilized to aid dispersal of liquid onto media. In further embodiments, it is of course also contemplated that powdered ingredients can be applied to the wetted pellets either before or after liquid application, with such powders being either soluble or insoluble within the liquid matrix and with such powders being powders formed of materials such as ground plant material, binding or thickening agents, active ingredients, moisture control agents, texture agents, and the like.

For additional information and guidance regarding the production of oral products making use of fibrous substrates and active ingredients such as nicotine, see, e.g., U.S. Patent Application Publication No. 2021/0251277, which is incorporated herein by reference in its entirety.

The presently-disclosed subject matter is further illustrated by the following specific but non-limiting examples.

EXAMPLES

Example 1—Development of Liquid Formulations

Experiments were undertaken during the course and development of the presently-described to determine liquid formulations capable of being effectively used with various substrates. Hydrophilic retention experiments were undertaken to assess which combination of propylene glycol (PG): vegetable glycerin (VG) best retained moisture, while also being able to provide for an improved shelf-life and consumer appeal. Further, manufacturing sizes were calculated and analyzed taking into consideration the dimensions of containers for the products, material capacity, ratio of pellet compression with saturation level and the like to estimate how much void space remains when reasonable compression using significant force is performed. These experiments further determined how well the liquid formulations can be distributed using compression and also determined the ideal fill volume for vessels used based on the physical attributes of the materials.

Experiments were further undertaken to examine the retention of the liquid formulations and, more particularly, the liquid affinity of fibrous substrate materials. As described below, individual pellets of known dry weight were saturated in each experiment using various percentages of propylene glycol, glycerin, or water alone, and were then weighed after saturation. The initial groups included: a 50/50 blend of vegetable glycerin and water; a 25/75 blend of vegetable glycerin and water; a 40/60 blend of vegetable glycerin and water; and a 25/50/25 blend of vegetable glycerin, water, and propylene glycol. In a further experiment, the experimental groups included: a 50/50 blend of propylene glycol and water; a 25/75 blend of propylene glycol and water; a 40/60 blend of propylene glycol and water; and a 25/50/25 blend of vegetable glycerin, water, and propylene glycol. Using a low contact handling method with minimal compression, each pellet was moved from initial placement and positioned in a fresh location on a clean non-porous surface. The process was then repeated until spot-blot puddling reduced noticeably and the resulting weight of the fiber-liquid (wet) pellet assembly was measured. The mass of wet pellets was then pressed using a flat, level surface, layers of absorbent, and a standard weight. Absorbents were discarded and the weight of the wet pellets was measured again. In some experiments, samples were also allowed to remain exposed to the air and their weight change was measured after a time. These experiments were then used to calculate how much that a particular pellet design could carry when saturated, when handled mildly, and when subjected to basic mechanical extraction methods. Pellet dimensions were further assessed in an effort to calculate pellet size, density, and volume the pellets would occupy in the finished container.

Figure 1B:
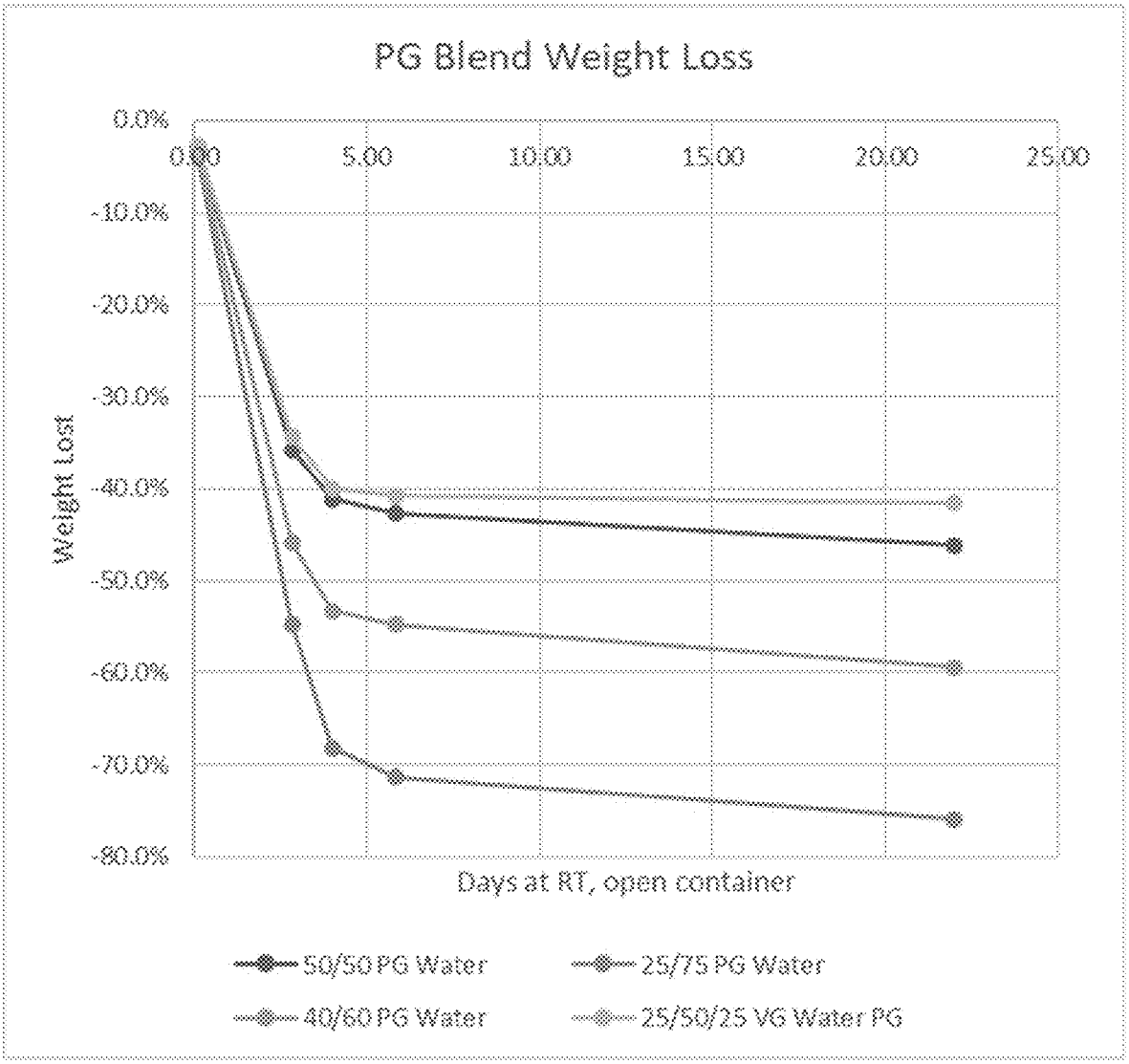

Moisture Retention of the products once placed in the containers (i.e., cans) was further assessed. Briefly, to assess moisture retention, samples and controls were filled with a standard amount of water (32 grams), sealed as normally intended, placed in a 48° C. forced circulating air oven (a gentle non-volatile high contact area heating), and weight loss over time was measured without opening the individual containers and with open containers. As shown in FIGS. 1A-1B, it was discovered that 50/50 blends of water and either propylene glycol or vegetable glycerin, as well as 25/50/25 blend of vegetable glycerin, water, and propylene glycol, provided less weight loss of time and thus exhibited superior moisture retention properties relative to blends including greater amounts of water. Relative rates of moisture loss were then calculated so as to examine what formulations allowed for extended shelf-life. Formulations were further adjusted for manufacturing yield losses during processing and to allow for increased nicotine levels to account for an approximately 10% decline in nicotine levels during processing due to waste, evaporation, and the like. Based on the analysis of the results from these experiments, liquid and oral product formulations were developed as provided in Table 1 below and which were subsequently observed to provide consistent flavor and active agent release, while allowing for ease of manufacturing and consistency in the manufacturing process, as described in further detail below.

TABLE 1

Recipe Targets by weight in finished product and with ingredients grouped by descending order of use.

| | Citrus | Mango | Berry | Mint | Wintergreen |
|---|---|---|---|---|---|
| Propylene Glycol | 36.1% | 35.1% | 35.7% | 35.5% | 33.9% |
| Polyester | 27.2% | 27.2% | 27.2% | 27.2% | 27.3% |
| Vegetable Glycerin | 26.6% | 26.6% | 26.6% | 26.6% | 27.2% |
| Water | 6.6% | 6.6% | 6.6% | 6.6% | 6.8% |
| Flavors | 1.2% | 2.0% | 2.0% | 2.1% | 1.5% |
| Triacetin | 0.97% | 0.96% | 0.4% | 0.4% | 0% |
| NTNicotine | 0.92% | 0.92% | 0.92% | 0.92% | 1.0% |
| Sucralose | 0.3% | 0.5% | 0.50% | 0.68% | 0% |
| Saccharine | 0% | 0% | 0% | 0% | 0.4% |
| Sorbitol | 0% | 0% | 0% | 0% | 2.0% |

Example 2—Nicotine Dissolution Analysis

Subsequent to the above-described analysis of the moisture retention properties and development of the various formulations, an evaluation of the dissolution of nicotine from the smokeless products was further conducted. Samples of the five formulations listed in Table 1 above were analyzed with three replicate collections performed for each of the five samples. Each collection incorporated nine fractions totaling a combined twenty-seven replicates per sample. All replicates for each formulation were performed on the same day. Ultra High Pressure Liquid Chromatography coupled to a UV detector (UPLC-UV) analysis was performed to assess the amount of nicotine in dissolution media for each of the formulations. Storage was maintained at ambient conditions until testing was performed. Samples for analysis were generated using the Dissolution Apparatus described in SOP EQU-127: SOTAX CE7 Smart Dissolution Apparatus, at 4 mL/min. Analyte concentrations were determined by either an internal or external standard calibration method using the regression equation derived from the calibration curve. Results were then converted and reported on a per weight, per device basis using the equations provided below that allowed reporting on a mass/mass or mass/pouch basis:

Nicotine Fraction (μg/gram): (Instrument Conc. (μg/mL)×Sample Volume (mL)×Fraction Volume (mL))/(Fraction Aliquot Volume (mL)×Sample Weight (g)) (I)

Nicotine Fraction (μg/pouch): (Instrument Conc. (μg/mL)×Sample Volume (mL)×Fraction Volume (mL))/Fraction Aliquot Volume (mL) (II)

Figure 3:
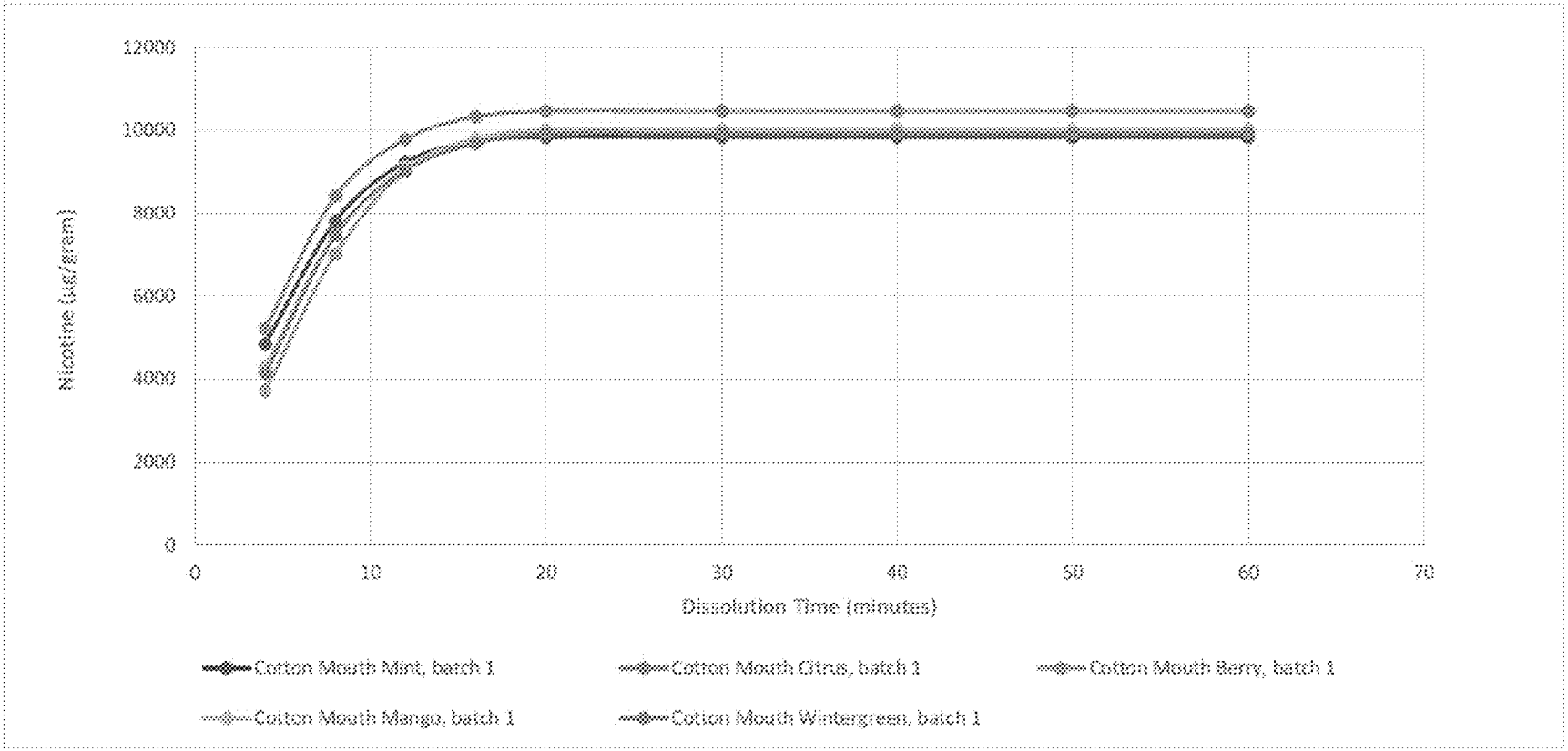
FIG. 3 is a graph showing nicotine dissolution profiles for oral products including various liquid formulations made in accordance with the presently-disclosed subject matter (Cotton Mouth Mint, Citrus, Berry, Mango, and Wintergreen), where each dissolution profile is shown as μg nicotine/gram of product versus dissolution time.
Figure 4:
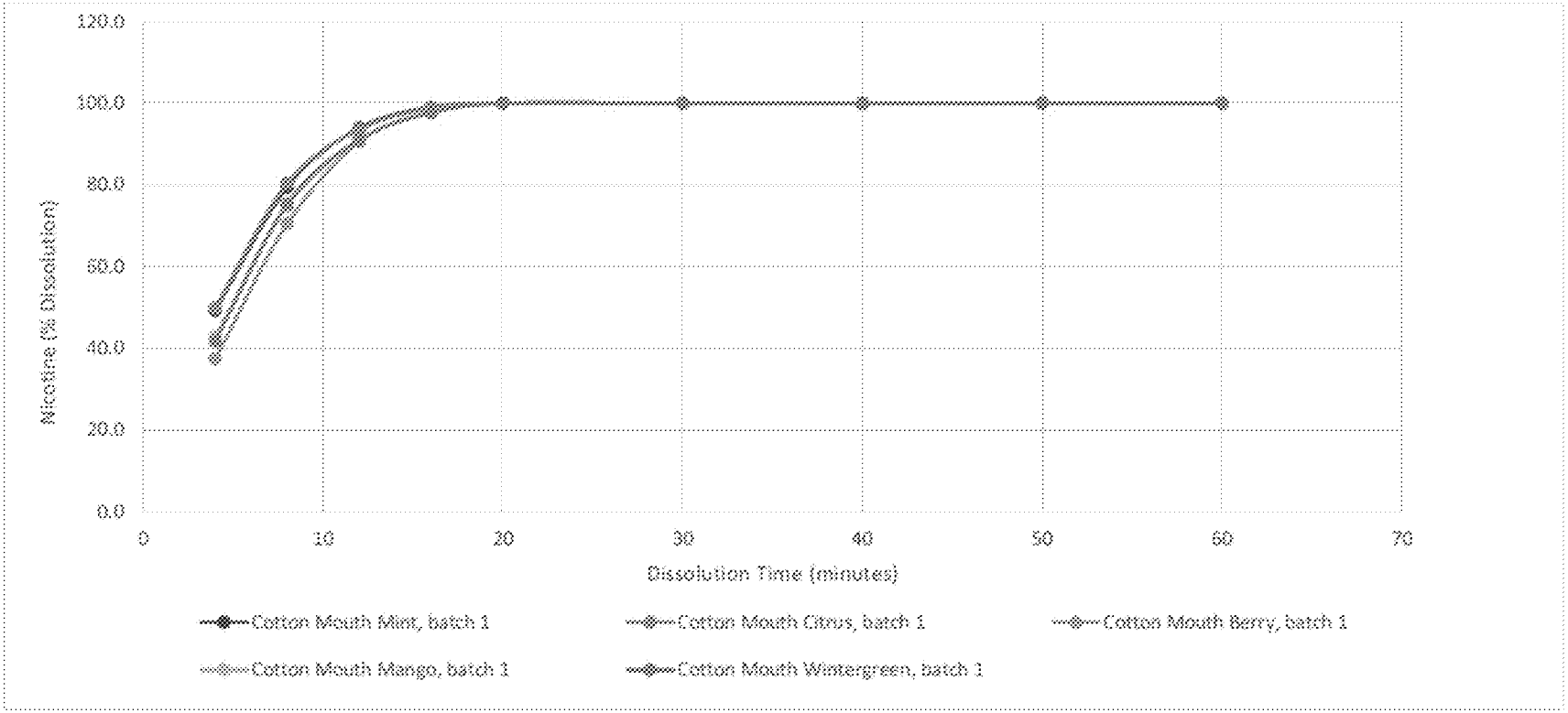
FIG. 4 is another graph showing nicotine dissolution profiles for oral products including various liquid formulations in accordance with the presently-disclosed subject matter (Cotton Mouth Mint, Citrus, Berry, Mango, and Wintergreen), where the dissolution profile is expressed and shown as percent dissolution of the nicotine included in the product versus dissolution time.
Figure 5:
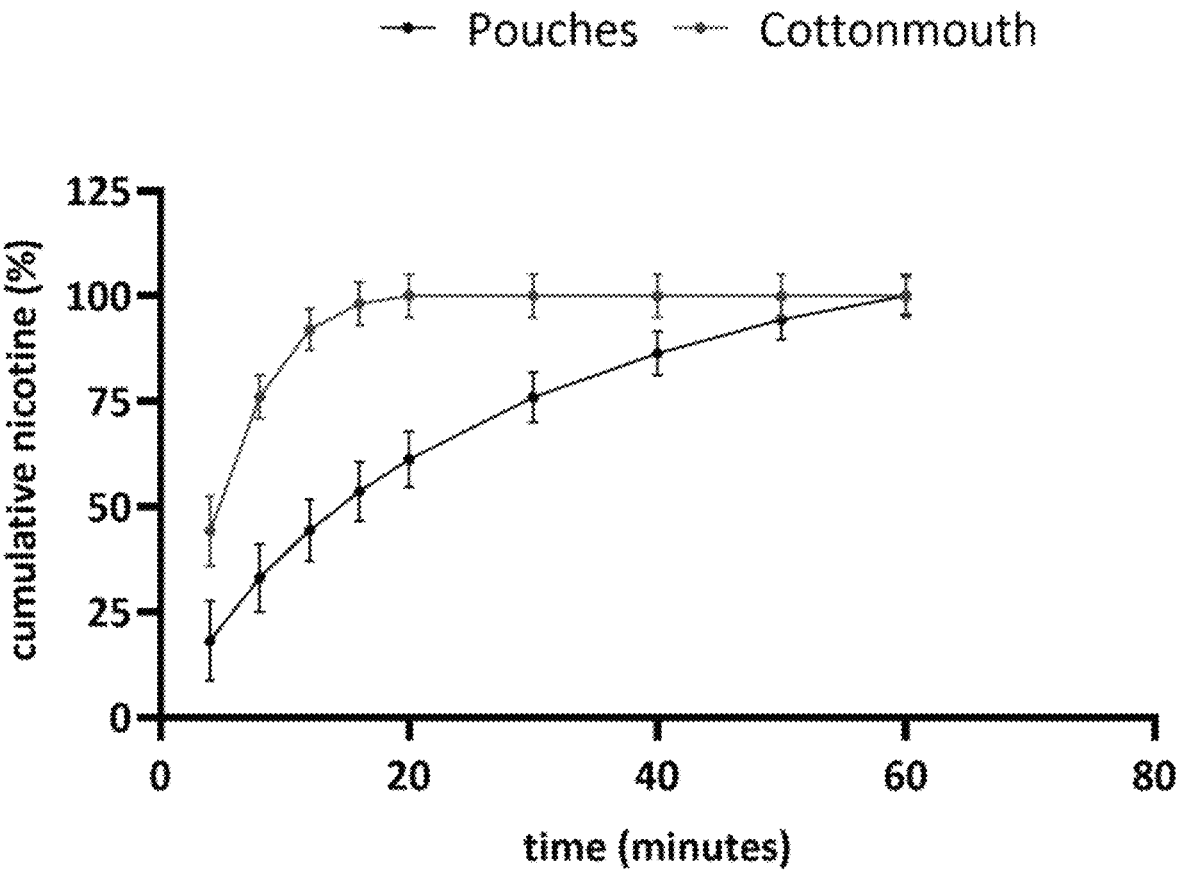
FIG. 5 is a graph showing nicotine dissolution profiles for oral products including a nicotine dissolution profile for an oral product produced using an exemplary liquid formulation of the presently-disclosed subject matter (Cotton Mouth) and a nicotine dissolution profile for a standard nicotine delivery oral pouch (Pouches).

The (lower) limit of quantitation of nicotine used for this study was 0.5 μg/mL which was equivalent to an 80 μg/pouch for a 16-mL fraction. The limit of detection for nicotine was 0.2 μg/mL which was equivalent to 32 μg/pouch. Dissolution Rate (% per min) was calculated as 100(%)/Time at 100% (minutes). As seen in FIGS. 3-4, upon the analysis of the results from these experiments, it was observed that the dissolution rates were approximately the same for each product test and were approximately 5% per minute. More significantly, however, it was further observed that when compared to commercially-available nicotine delivery pouches, the presently-disclosed formulations and products had a greater dissolution rate with 100% of the nicotine being delivered in 20 minutes versus a full 60 minutes that was required by the pouches for a full release or dissolution of the nicotine included in those pouches, as shown in FIG. 5.

Figure 6:
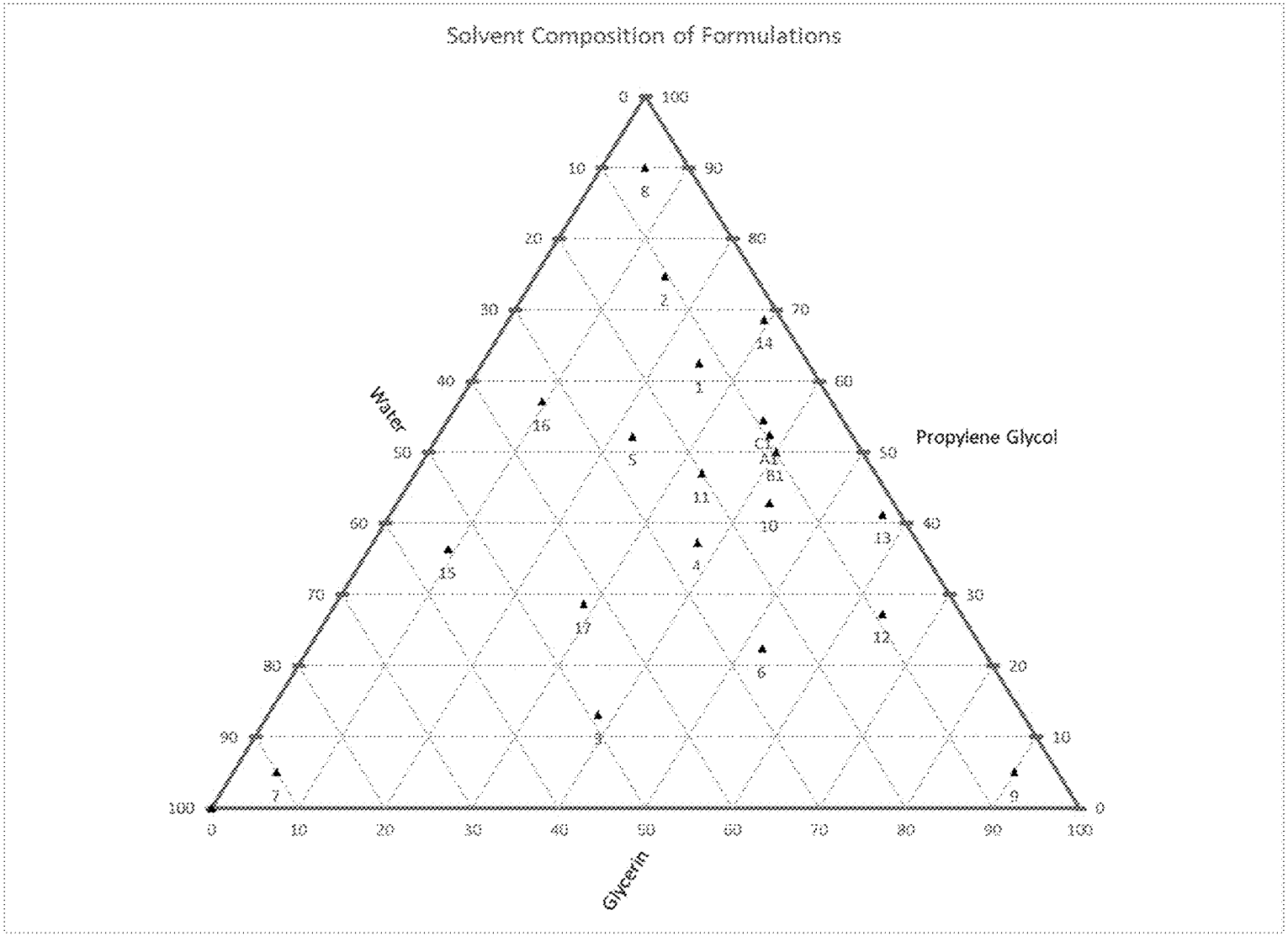
FIG. 6 is a ternary chart illustrating solvent fractions by formulation, where the values shown for each ingredient represent the ingredient amount relative to the other two such that each point sums to 100% and does not include other liquid components.

Example 3—Liquid Design, Liquid Attributes, Liquid-Solid Interaction, and Finished Product Quality As a result of the unexpected results obtained during the initial investigations into moisture retention and nicotine release profiles among the various formulations, further investigation was undertaken to assess the formulations for liquid design, liquid attributes, liquid-solid interaction, and desirable finished product quality. As part of these additional experiments, formulations were prepared across a range of solvent ratio variations as illustrated in FIG. 6. Solutions were prepared by weight as listed in Table 2 using the materials as indicated.

Liquid formulations were assessed for solubility both before and after the final addition of the active ingredient (nicotine). Nicotine containing liquids were then assessed in practice by application to the two types of media compared: dental cotton pellets and polyester pellets. Measures taken were then used to model product component requirements across the range of optimal conditions.

As described in further detail below, upon the analysis of the results of these additional experiments, it was observed that the ingredients and amount included in the formulations resulted in not only a stable liquid formulation, but one with properties that were unique to the intended product application. In particular, when prepared as described herein, the formulations were capable of providing a pleasant and consistent user experience, within small margins of error, while also providing accurate active component (e.g., nicotine) delivery with improved product quality retention.

TABLE 2

Liquid formulation preparations used for study as percentage of total weight. Formulas with letter prefixes illustrate features of the embodiment. Formulations with "b" added illustrate a variation using an alternate flavor.

| | Propylene glycol | Vegetable glycerin | Water, deionized | Nicotine | Sorbitol | Wintergreen Flavor | Mint Flavor | Saccharin |
|---|---|---|---|---|---|---|---|---|
| 1 | 60.0% | 24.0% | 12.0% | 1.3% | 0.0% | 0.0% | 2.7% | 0.0% |
| 1b | 60.0% | 24.0% | 12.0% | 1.3% | 0.0% | 2.6% | 0.0% | 0.0% |
| 2 | 71.7% | 14.3% | 10.0% | 1.3% | 0.0% | 2.7% | 0.0% | 0.0% |
| 3 | 12.5% | 36.5% | 47.0% | 1.3% | 0.0% | 2.7% | 0.0% | 0.0% |
| 4 | 35.8% | 35.8% | 24.4% | 1.3% | 0.0% | 2.7% | 0.0% | 0.0% |
| 5 | 50.2% | 21.5% | 24.4% | 1.3% | 0.0% | 2.7% | 0.0% | 0.0% |
| 6 | 21.5% | 50.2% | 24.4% | 1.3% | 0.0% | 2.7% | 0.0% | 0.0% |
| 7 | 4.8% | 4.8% | 86.4% | 1.3% | 0.0% | 2.7% | 0.0% | 0.0% |
| 8 | 86.4% | 4.8% | 4.8% | 1.3% | 0.0% | 2.7% | 0.0% | 0.0% |
| 9 | 4.8% | 86.4% | 4.8% | 1.3% | 0.0% | 2.7% | 0.0% | 0.0% |
| 10 | 41.2% | 41.2% | 13.7% | 1.3% | 0.0% | 2.7% | 0.0% | 0.0% |
| 11 | 48.0% | 36.0% | 12.0% | 1.3% | 0.0% | 2.7% | 0.0% | 0.0% |
| 12 | 26.2% | 61.1% | 8.7% | 1.3% | 0.0% | 2.7% | 0.0% | 0.0% |
| 13 | 39.6% | 54.4% | 2.0% | 1.3% | 0.0% | 2.7% | 0.0% | 0.0% |
| 14 | 65.9% | 28.2% | 1.9% | 1.3% | 0.0% | 2.7% | 0.0% | 0.0% |
| 15 | 34.9% | 8.7% | 52.4% | 1.3% | 0.0% | 2.7% | 0.0% | 0.0% |
| 16 | 54.9% | 9.1% | 32.0% | 1.3% | 0.0% | 0.0% | 2.7% | 0.0% |
| 17 | 27.4% | 27.4% | 41.2% | 1.3% | 0.0% | 2.7% | 0.0% | 0.0% |
| A1 | 50.4% | 36.5% | 9.1% | 1.3% | 0.0% | 0.0% | 2.7% | 0.0% |
| A1b | 50.4% | 36.5% | 9.1% | 1.3% | 0.0% | 2.6% | 0.0% | 0.0% |
| A2 | 50.4% | 36.5% | 9.1% | 1.3% | 0.0% | 2.7% | 0.0% | 0.0% |
| B1 | 46.7% | 37.3% | 9.3% | 1.3% | 2.7% | 2.1% | 0.0% | 0.5% |
| C1 | 52.4% | 34.9% | 8.7% | 1.3% | 0.0% | 0.0% | 2.7% | 0.0% |
| C1b | 52.4% | 34.9% | 8.7% | 1.3% | 0.0% | 2.6% | 0.0% | 0.0% |

The materials and devices utilized in these additional experiments included: 1 gallon F-style jugs, fluorinated (UNLINE, item #S-22891); Balance (Mettler PM11-K; Mettler Toledo X603 S); 50 mL clear plastic bottle with child resistant cap (Chubby Gorilla); propylene glycol, USP FCC (Brenntag); vegetable glycerin, 99.7%, USP (Brenntag); water, deionized (potable water, filter treated, Evoqua Water Technologies); Nicotine, USP (Tobacco Technologies); Sorbitol, 70%, USP FCC (Brenntag); Wintergreen Flavor, food grade (Mane); Mint Flavor, food grade (Purilium); Sodium Saccharin (Blue Circle Organics Pvt. Ltd.); Density Meter (Anton Paar, model DMA™ 4500 M); Polyester fiber, 6 mm punched pellets (Barnhardt, part #00POL108P); Cotton pellets, Size 3 (Richmond Dental & Medical, item #101108); CORNING PYREX® Labware, petri dish, 60 mm×15 mm, part #3160-60; High precision Balance (Mettler Toledo XP204T); Medium Tipped Tweezer (Excelta™ 20A-S-SE); and Pour Boat Weighing Dish, Disposable, Polystyrene, Anti-Static, 3-½ in.×5-¼ in.×1 in. (Preiser Scientific, Item 10-1779-02).

To examine the solubility of the liquid formulations, the formulations were prepared as described above in Table 2. Solution preparations were made in bulk (3 kg) scale using 1-gallon jugs and analytical balances in a manner to resemble the practical application. After assembly and mixing, an aliquot was taken from each bulk mixture. Aliquots were then placed in clear, sealed, uniform containers and allowed to stand undisturbed for a recorded time period. Observations continued until conditions remained stable for 20 hours or more. Assessments were then attributed to the earliest time point representing the final condition. Consideration for proper assessment was given to the container uniformity to allow visual assessments, changes over time, and maintaining the solution equilibrium.

Figure 7:
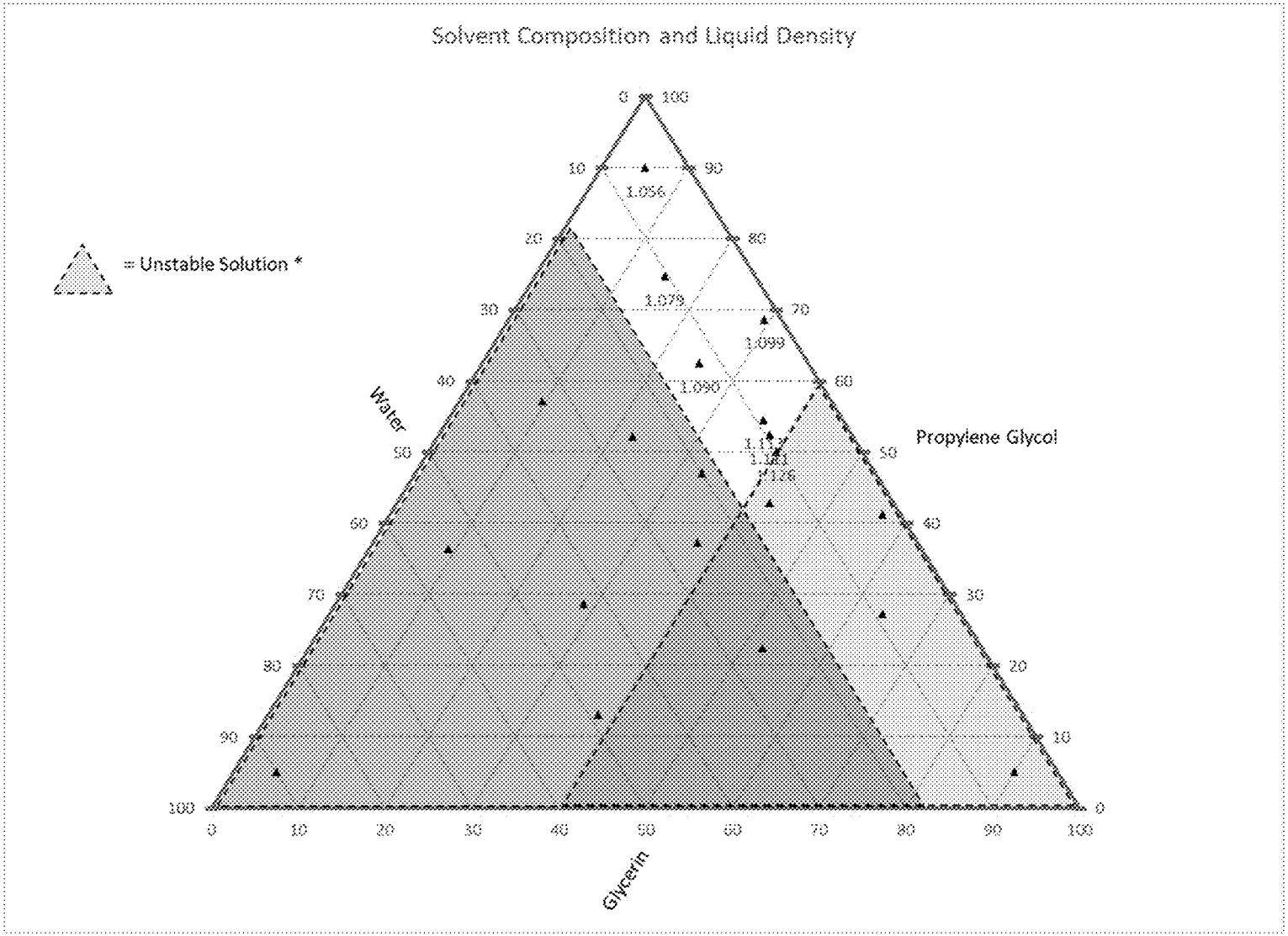
FIG. 7 is another ternary chart illustrating solubility incompatibilities and the liquid densities of stable formulations at 20° C.

Upon analysis of the results, it was observed that stable solutions were the quickest to reach equilibrium. Unstable solutions took 100 hours or more before setting into state, where the unstable solutions commonly featured liquid partitioning either on the top, bottom, or sides of the solution container. An illustrative summary of solution stability is presented in FIG. 7. Densities of stable solutions were subsequently collected using bench top instrumentation (Anton Paar, model DMA™ 4500 M).

It was also observed that higher levels of glycerin created striated layers throughout the liquid mass, indicating variable liquid shear rates due to impartial solubilities and a resulting mixture. Unstable formulations often featured a long-lasting cloudy appearance following the initial blending that may or may not feature such striations. Further, the amount of water, in both extremes, was associated with bead-like liquid partitioning along the container's side wall. Moderate water inclusion featured liquid layer separation either at the surface or base layer of the mixture. Formulations with the higher amounts of water also suffered from increased evaporative losses when applied to the carrier media (see, e.g., #15 in FIG. 12).

Due to the potential risk posed by selective solubilities paired with a soluble active ingredient (such as nicotine), only stable liquid formulations were considered to be viable. By using stable solution formulations, the resulting product provided greater uniformity and product consistency for all deliverables (taste, texture, active component delivery, et al.). Furthermore, proper solubility could logically limit environmental stripping caused by differential exposures and other mechanisms that would likely lead to product inconsistencies.

With regard to the viscosity of the formulations, it was appreciated glycerin is a highly viscous ingredient common to consumable goods. Due to the reliance on liquid to carrier media surface interactions, investigational formulations favored higher viscosity options within the parameters enabling favorable solubility (see FIG. 7). Viscosity was not capable of being directly measured due to the likely impacts of the microscale interactions within the fibrous media being investigated; rather, practical measures of the combine solutions were made as described below.

With that in mind, it was found that common consumable good ingredients used in the formulations could impact organoleptic perceptions and/or create certain mouth feel textures of either desirable or unfavorable appeal. For example, propylene glycol was found to have an oily, bitter, and/or warming character depending on the concentration and combined manner of use. Inclusion of water was capable of alleviating some of those perceptions but not all formulations were so inclined as was discovered using feedback from expert sensory panelists in relation to formulations #2, 8, and 14 as described in Table 2. Moreover, both glycerin and propylene glycol were known humectants which can retain or absorb water. Water was thus included in the formulations as a preconditioning for finished product weight stability as well as improved sensory perceptions during use in the buccal cavity, as previously described (data not presented).

It was also discovered that favorable formulations featured a level of water inclusion, in combination with the other ingredients components, to be below 0.60 water activity (Aw) in the finished product, an important point where no microbial proliferation was commonly known to occur. Propylene glycol was also known to reduce microbial activity whether used in liquid or solid medias at an appropriate level.

To analyze the carrying capacity of the polyesters fibers used in accordance with the presently-disclosed subject matter, initial assessments of cotton pellets were performed with respect to variability of size, completeness of form, or other defects as such observed variability prompted such pre-screening selection to improve experiment comparisons. Screening selected forms of average size, uniformity, and completeness of shape. Weights of both media types (i.e., cotton and polyester (PET)) were then measured but not selected for with the entire selection screening process being performed to provide a clearer fundamental relationship between the two pellet types.

Liquids, as described above (Table 2), were applied to both PET and cotton pellet forms. Two unstable mixtures (#10 and #15) were included as well and each mixture was well mixed immediately prior to use. Using the high precision balance, the dry weight of each pellet material was recorded for each run. Dry pellets were placed, independently and in a singular layer, in glass petri dishes which were then filled with the appropriate liquid formulation being studied. Samples were observed for dry spots, which would prompt additional liquid addition, until none were observed. Each condition was allowed to soak for 10 minutes in room temperature conditions without disruption. After saturation, the pellets were removed, one at a time, using tweezers in contact with the pellet terminal edge so as to not squeeze, deform, or otherwise modify the liquid carrying capacity of pellet integrity. Saturated pellets were placed without contact to each other on the flat surfaces of a clean, dry, and non-absorbent tared disposable weigh boat and the weight recorded.

The saturated pellets, so positioned, were allowed to stand for 1 hour in ambient room temperature conditions (72° F., no humidity control). Pellets were then handled with tweezers, in the same manner previously described, and reweighed using a fresh weigh boat. The resulting findings illustrated a weakness in liquid carrying capacity possibly describing solid-liquid interactions, morphological biases and/or other mechanisms. Higher consistencies by the PET pellets illustrated their innovation and usefulness over the use of cotton pellets for the described formulations (see Table 3). While cotton pellets had a higher initial carrying capacity by unit weight, that attribute was not as resistant to change over time, nor as repeatable.

Figure 8:
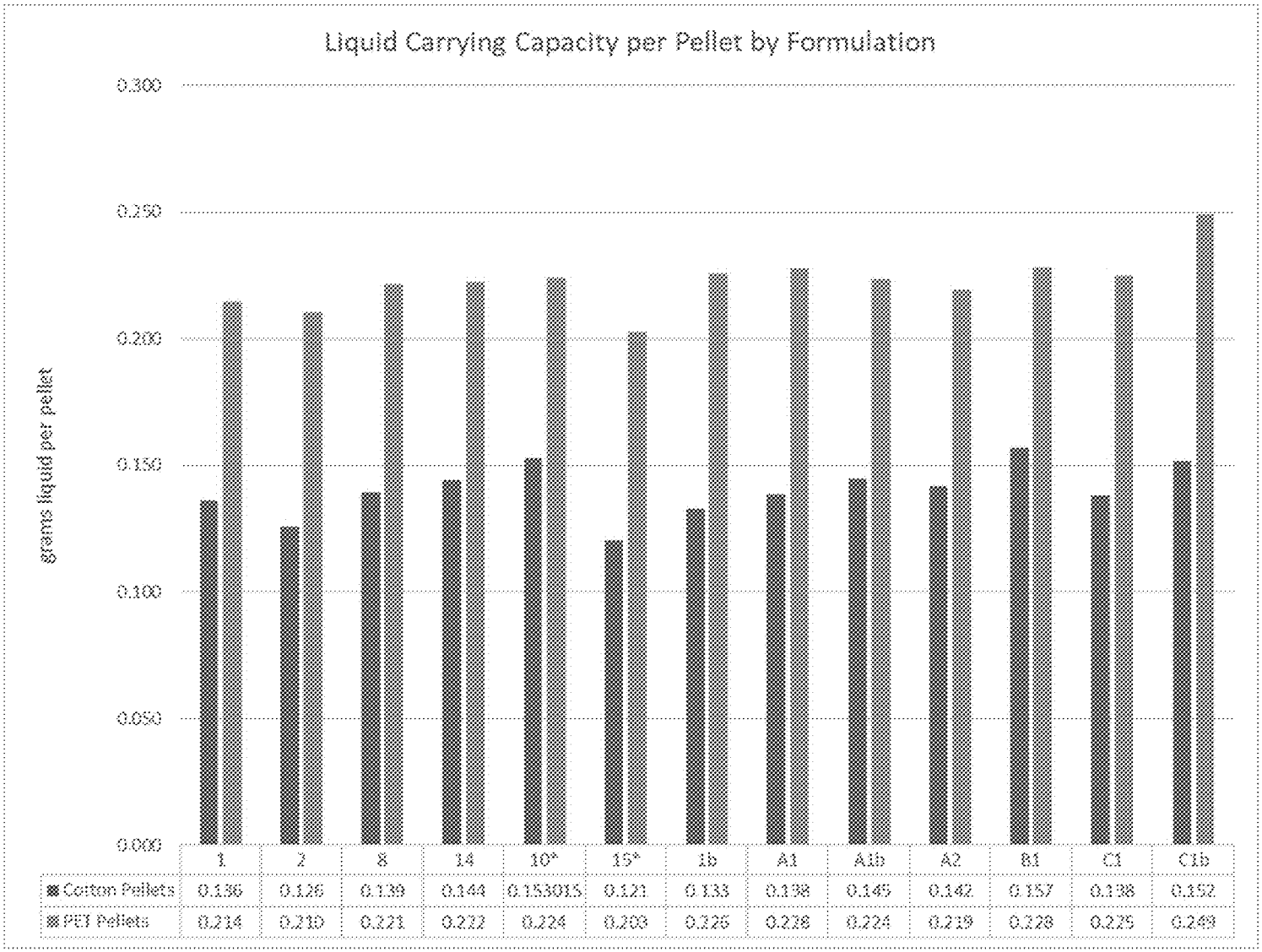
FIG. 8 is a graph showing saturation carrying capacity per pellet, where the mean dry pellet weight was 0.0061 g for Cotton and 0.0110 g for PET.
Figure 9:
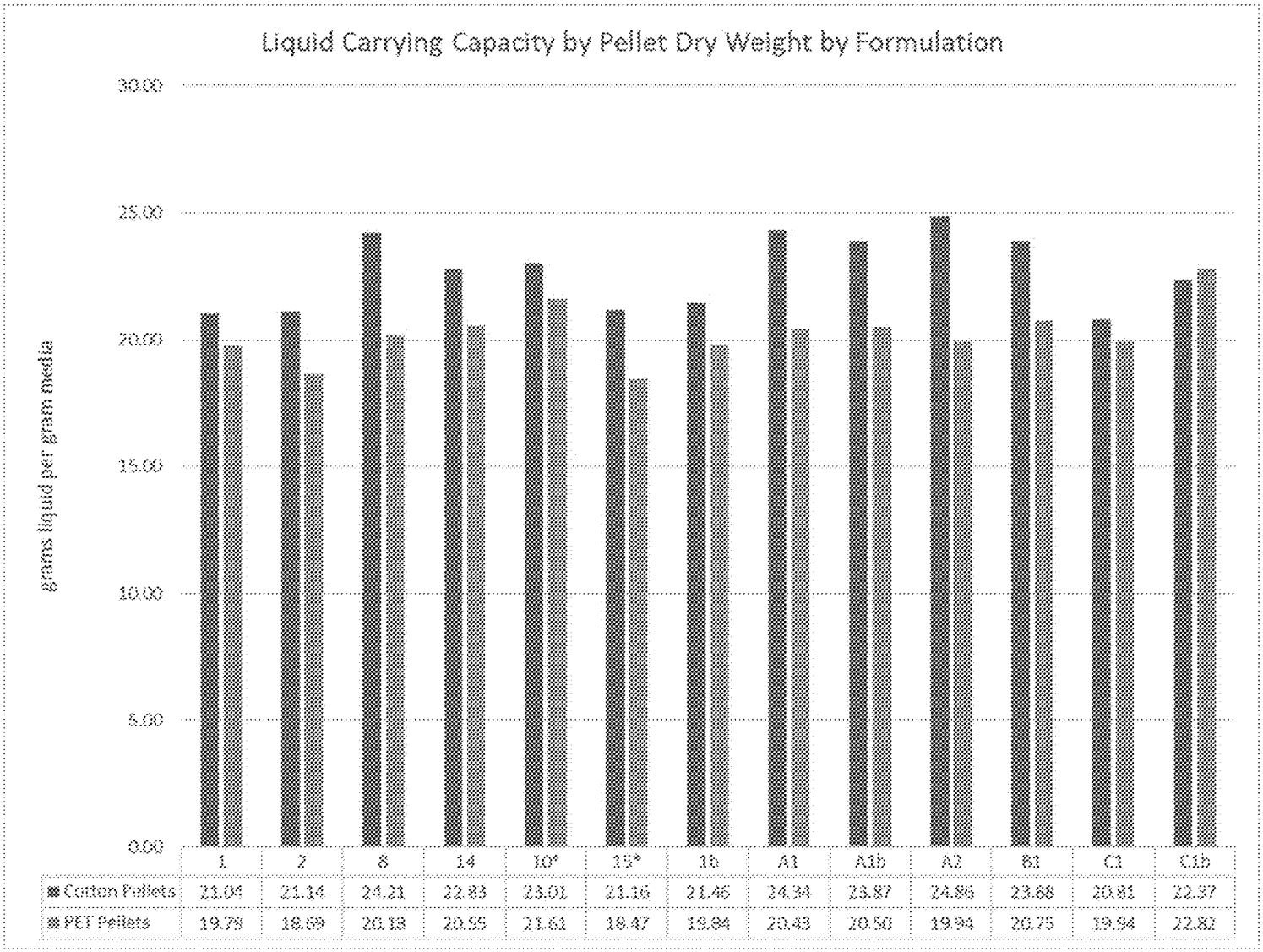
FIG. 9 is a graph showing saturation carrying capacity by carrier media weight.
Figure 10:
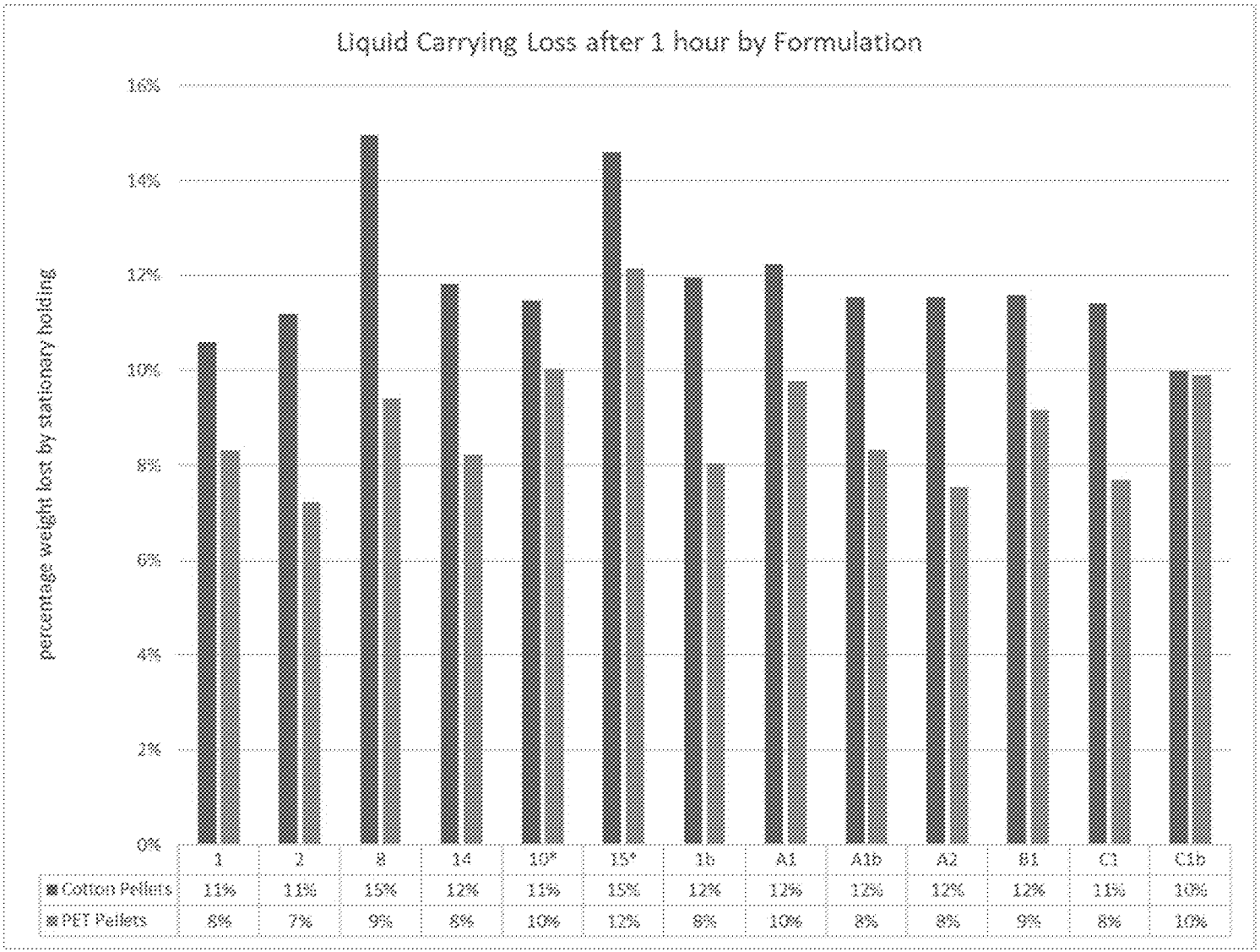
FIG. 10 is a graph showing container transfer losses after a 1-hour undisturbed holding period on a flat non-absorbent surface (static carrying capacity).
Figure 11:
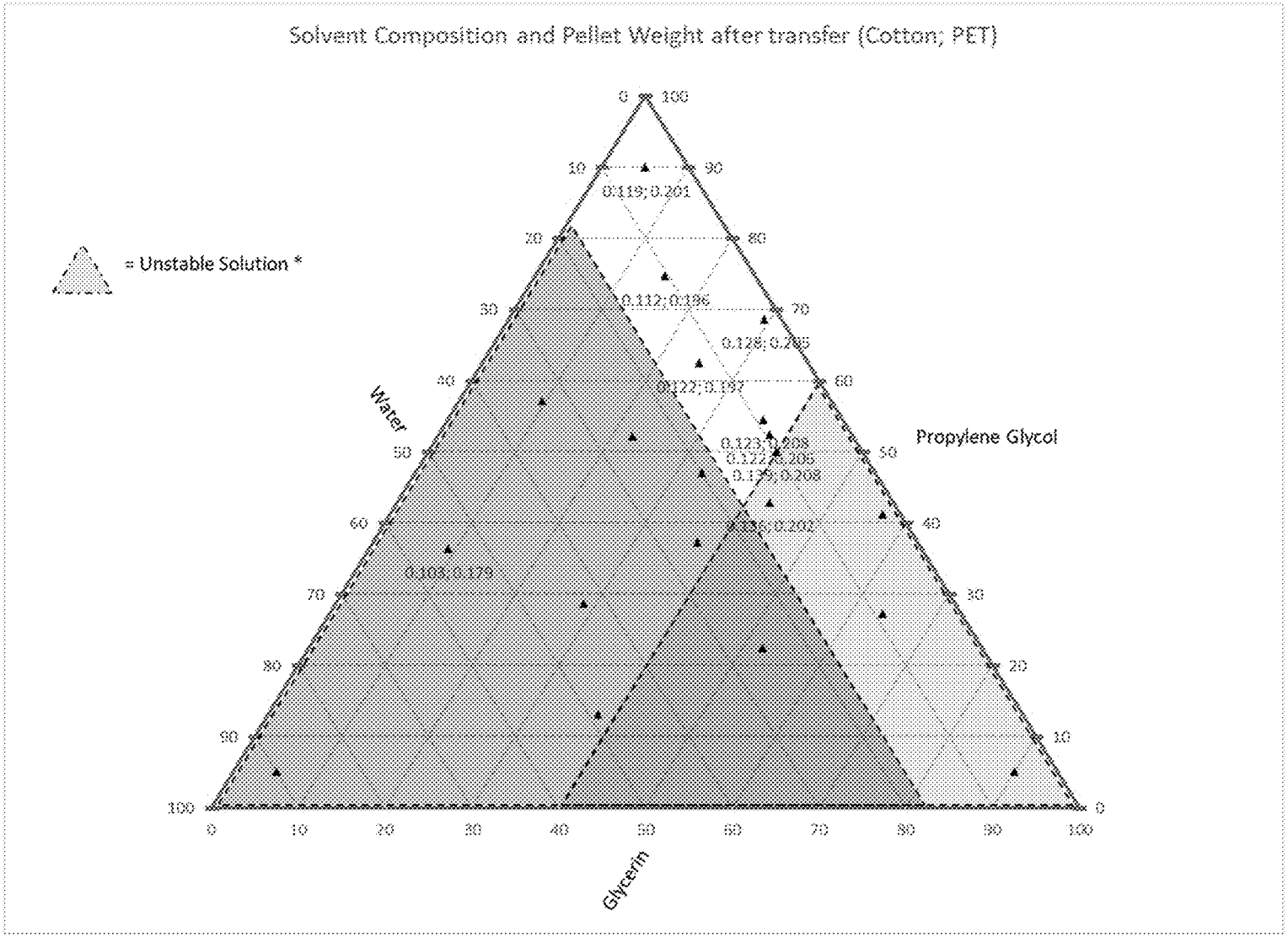
FIG. 11 is a graph showing average pellet weight after container transfer, both cotton and PET by formulation, following a 1-hour undisturbed holding period on a flat non-absorbent surface.
Figure 12:
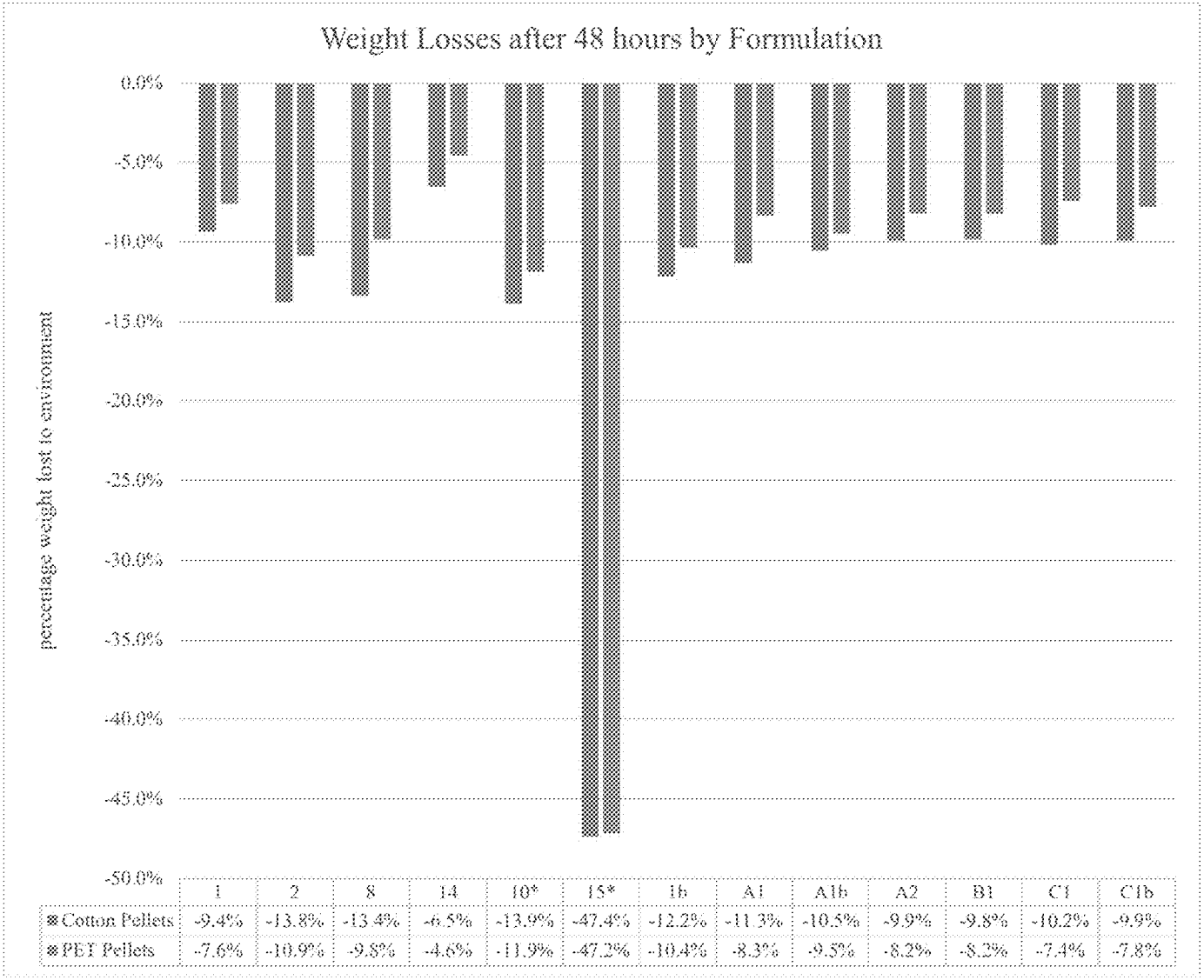
FIG. 12 is a graph showing relative losses to the environment during storage without disruption (open to air for 48 hours, 72° F., no humidity control).

After the initial assessment, the samples were then allowed to stand, uncovered, for 48 hours. After remaining on a flat surface, undisturbed, as unique particles (not clumps or groups), in identical storage conditions they were weighed, recorded, and losses calculated from the static carrying capacity condition (FIG. 12). For these analyses, the calculation of pellet weight was determined by: X/Y, where X=weight of pellets, and Y=number of pellets (see FIGS. 8 and 11). The calculation of saturation carrying capacity of material was determined using the formula: (B−A)/A, where A=Dry weight of pellets, grams, and where B=Wet Weight of pellets and liquid (Saturated pellets) in grams (see (FIG. 9, Table 3). The calculation of weight change after standing for 1 hour (static carrying capacity) was determined using the formula: (B−C)/B, where B is as indicated above and C=Wet weight after transfer to clean container in grams (see FIG. 10). Calculation of environmental losses was determined with the formula: (D−C)/C, where C is as indicated above and D=Wet weight after 48 hours of environmental exposure in grams (see FIG. 12). Lastly, the calculation of pellet liquid volume, mL was determined by the formula: C/E, where C is as indicated above and E=density of liquid, g/cm$^3$ at 20° C. (see FIG. 13).

From these experiments, it was determined that PET pellets have a higher carrying capacity per piece (FIG. 8) and exhibited that carrying capacity in a more consistent manner (FIG. 9, Table 3). The PET pellets utilized featured a higher weight than the cotton pellets studied. Cotton pellets of similar weight were excluded from study due to the uncomfortable and tougher texture when used in the buccal cavity.

Figure 13:
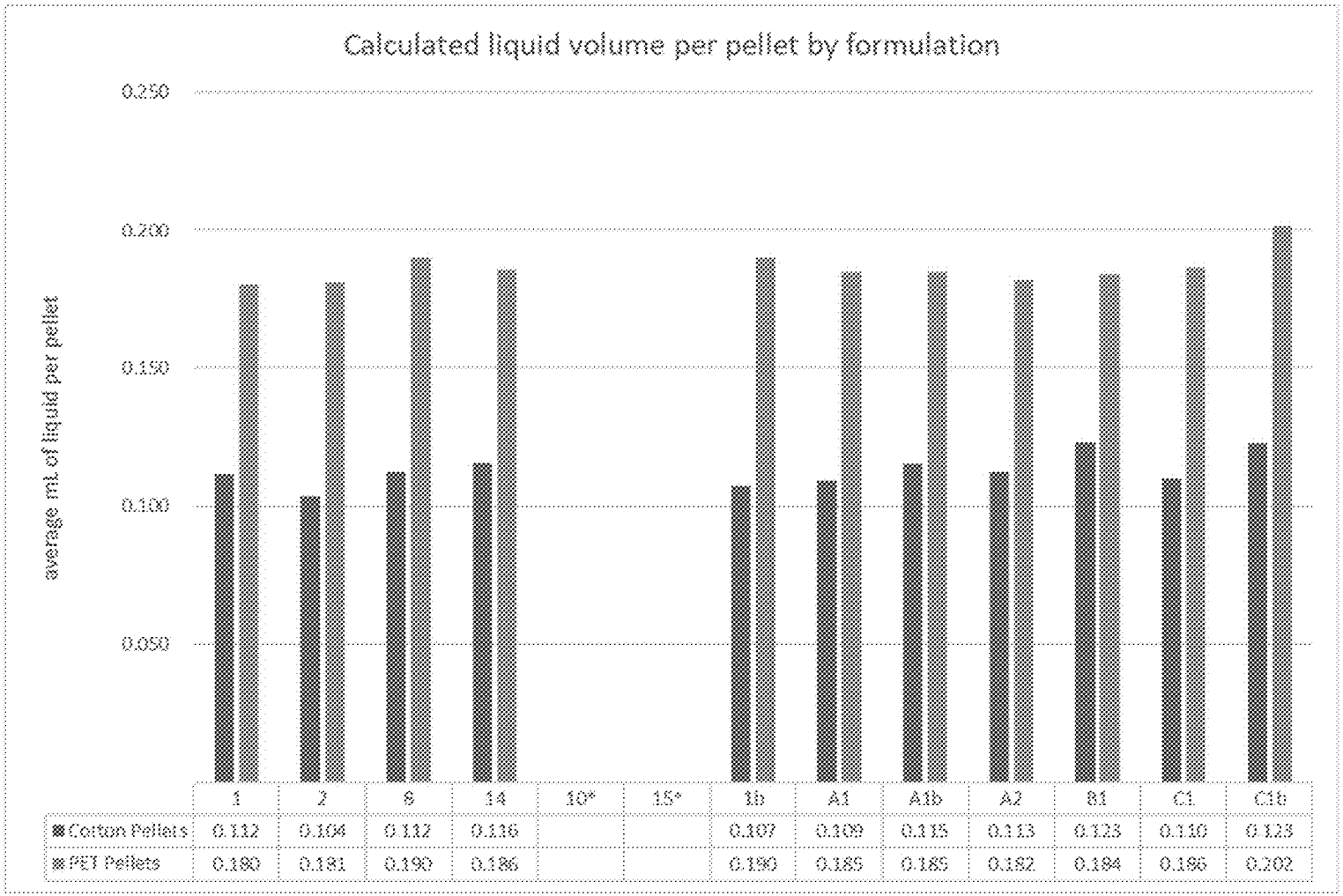
FIG. 13 is a graph showing calculated liquid volume per pellet by media type, where formulation #10 and formulation #15 could not be assessed due to the unstable nature of their mixture densities.
Figure 14:
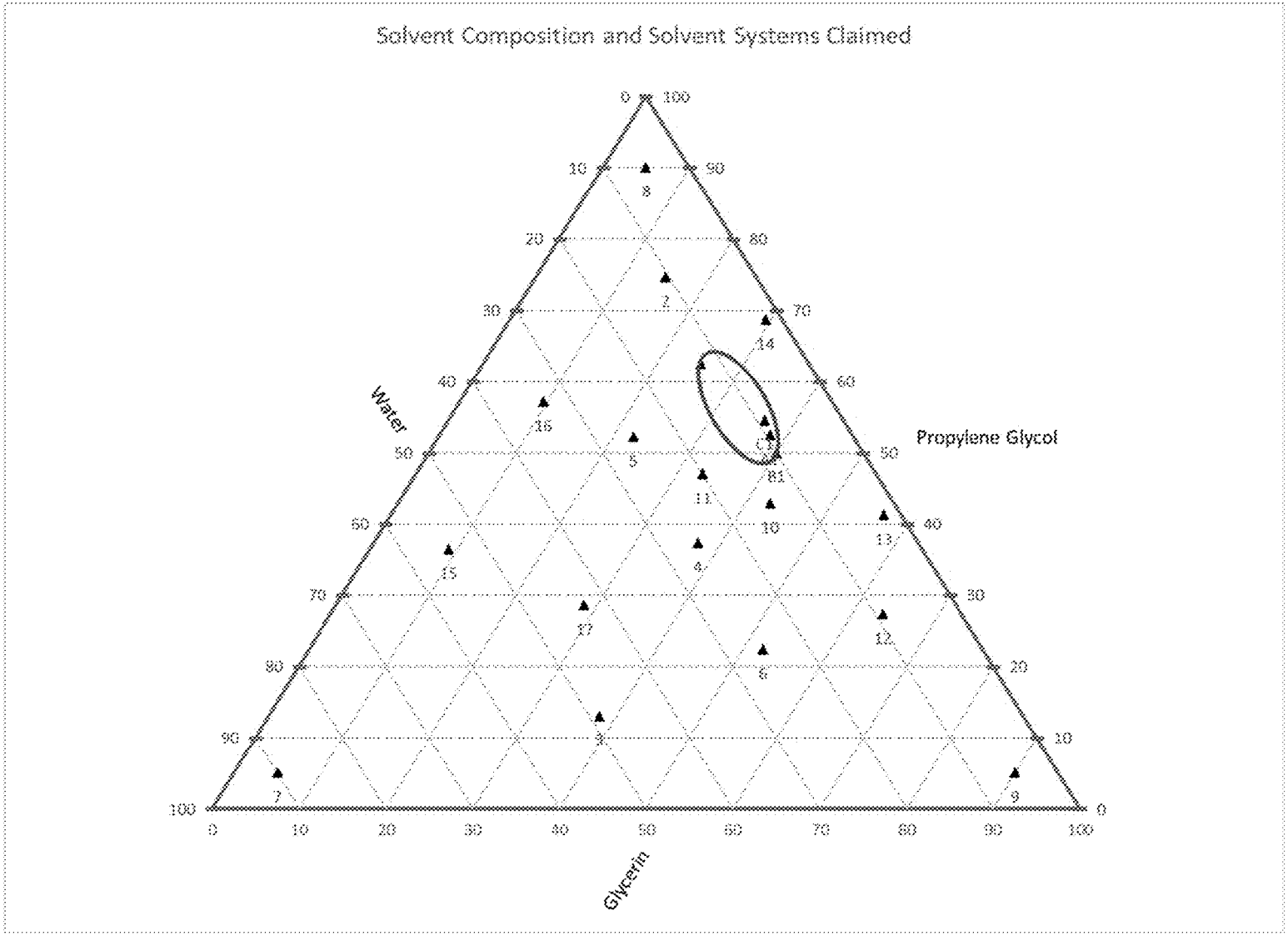
FIG. 14 is another ternary graph illustration of the portion of formulation identified for product application.

Furthermore, PET pellets better maintained the liquid load over time in both static retention experiments (FIGS. 10-11) and after exposure to the environment (FIG. 12). Using the density of each liquid formulation and the retained liquid per pellet unit from static carrying capacity, the PET pellet illustrated a higher volume capacity (FIG. 13). In this regard, the product was configured to utilize about 12% to about 25% of the total liquid carrying capacity (14% to 27% of the static liquid carrying capacity) as this was found to both alleviate the difficulty of manufacturing and aid in product consistency by maintaining a reservoir of additional carrying capacity.

TABLE 3

Statistics for saturation carrying capacity by weight across all formulations.

| | PET (g) | Cotton (g) |
|---|---|---|
| Mean | 20.32 | 22.69 |
| Median | 20.30 | 22.83 |
| Standard Deviation (SD) | 1.09 | 1.45 |

To assess the morphology of the resulting products as it relates to the various liquid formulations, additional experiments were performed using the cotton and PET materials. Cotton pellets are commonly manufactured using loose fibers spun onto a spindle. Such a spun form, however, creates novel morphological features, such as loose tendrils on the exterior surfaces as well as a cavity that is formed after the spindle is removed. Such variability was believed to be problematic as it related to the liquid formulations described herein, as those formulations required a liquid carrying media that was easy to portion when removed from a bulk container. Furthermore, given the nature of the product, the liquid formulations had to be distributed evenly within the bulk material and the individual portions of that material.

With that in mind, it is further appreciated that cotton tendrils intertwine during contact with each other, and that this behavior can be accelerated during processing. The result is often a mass of particles that are essentially tied together, which would both be inconvenient and difficult to portion from a manufacturing standpoint given the liquid carrying nature of the cotton. Such a mass would also be undesirable to a user who would often be selecting the product for use using only a single hand. Manufacturing would likewise be impacted by complicating both material flow and liquid distribution processes.

PET forms, on the other hand, use a novel process that presents a uniform material with the proper physical and morphological attributes. Furthermore, the PET pellets do not suffer from external morphological features that could inhibit or upset uniform distribution within the product bulk material. During manufacturing processes PET forms were also found to have greater durability in retaining their original shape than cotton pellets.

At the conclusion of the experiments described in this Example, and using the experimental results, calculations of finished product ingredient amounts were performed to discover the range of finished attributes required to achieve this product application. This additional analysis revealed that the necessary design features resulted from a combination of the individual components and amounts of those components included in the formulations. In particular, it was observed that using the ingredient-based liquid formulations described herein, a pellet weight ranging from 19% to 34% of the finished product was considered important to maintain an accurate active ingredient concentration, regardless of the finished product active ingredient targeted amount. Moreover, given that flavoring ingredients can have variable usage levels for reasons of intensity, impact, complexity, preference, or otherwise, the values identified were inclusive of a rational usage level range (i.e. flavoring ingredient loads from 0.8% to 8% of the finished product weight) with the balance of material being taken from propylene glycol and/or glycerin. In this regard, it was determined that formulations with acceptable organoleptic features, proper solubility, and consumer-focused metrics included: 30.8% to 48.6% propylene glycol in the finished product; 15.0% to 30.2% glycerin in the finished product; and 5.8% to 9.7% water in the finished product.

All publications, patents, and patent applications mentioned in this specification are herein incorporated by reference to the same extent as if each individual publication, patent, or patent application was specifically and individually indicated to be incorporated by reference.

It will be understood that various details of the presently disclosed subject matter can be changed without departing from the scope of the subject matter disclosed herein. Furthermore, the foregoing description is for the purpose of illustration only, and not for the purpose of limitation.

What is claimed is:

1. A liquid formulation for use in an oral product, comprising:

about 85% w/w to about 95% w/w of a carrier liquid;

about 1% w/w to about 5% w/w of a flavoring agent;

about 1% w/w to about 2% w/w of an active ingredient; and about 0.5% w/w to about 3.5% w/w of a sweetener, wherein the carrier liquid comprises about 30% w/w to about 50% w/w of propylene glycol, about 15% w/w to about 30% w/w of glycerin, and about 5% w/w to about 10% w/w water.

2. The liquid formulation of claim 1, wherein the glycerin is vegetable glycerin.

3. The liquid formulation of claim 1, wherein the active ingredient comprises nicotine.

4. The liquid formulation of claim 1, further comprising about 1% w/w to about 6% w/w of a binding agent.

5. The liquid formulation of claim 1, and wherein the sweetener comprises sucralose or saccharine.

6. An oral product, comprising:

about 25% w/w to about 30% w/w of a fibrous substrate;

about 50% w/w to about 70% w/w of a carrier liquid;

about 1% w/w to about 5% w/w of a flavoring agent;

about 0.5% w/w to about 2% w/w of an active ingredient; and about 0.1% w/w to about 3.5% w/w of a sweetener, wherein the carrier liquid comprises about 30% w/w to about 50% w/w of propylene glycol, about 15% w/w to about 30% w/w of glycerin, and about 5% w/w to about 10% w/w water.

7. The oral product of claim 6, wherein the active ingredient comprises nicotine.

8. The oral product of claim 7, wherein the nicotine is included in the formulation in an amount of about 0.5% w/w to about 1% w/w.

9. The oral product of claim 6, further comprising about 0.5% w/w to about 6% w/w of a binding agent.

10. The oral product of claim 6, and wherein the sweetener comprises sucralose or saccharine.

11. The oral product of claim 6, wherein the fibrous substrate is comprised of a synthetic polymer.

12. The oral product of claim 11, wherein the synthetic polymer is polyester.

13. The oral product of claim 6, wherein the oral product comprises:

about 36% w/w propylene glycol;
about 27% w/w of a polyester fibrous substrate;
about 27% w/w vegetable glycerin;
about 7% w/w water;
about 1% w/w to about 2% w/w of a flavoring agent;
about 1% w/w triacetin;
about 1% w/w nicotine; and
about 0.5% sucralose.

14. The oral product of claim 6, wherein the oral product comprises:

about 34% w/w propylene glycol;
about 27% w/w of a polyester fibrous substrate;
about 27% w/w vegetable glycerin;
about 7% w/w water;
about 1% w/w to about 2% w/w of a flavoring agent;
about 2% w/w sorbitol;
about 1% w/w nicotine; and
about 0.5% saccharine.

15. A method of making an oral product, comprising:

providing a liquid formulation including about 85% w/w to about 95% w/w of a carrier liquid,
about 1% w/w to about 5% w/w of a flavoring agent,
about 1% w/w to about 2% w/w of an active ingredient, and
about 0.5% w/w to about 3.5% w/w of a sweetener; and combining the liquid formulation with a fibrous substrate, wherein the carrier liquid comprises about 30% w/w to about 50% w/w of propylene glycol, about 15% w/w to about 30% w/w of glycerin, and about 5% w/w to about 10% w/w water.

16. The method of claim 15, wherein combining the liquid formulation with the fibrous substrate comprises sorbing the liquid formulation onto the fibrous substrate.

17. The method of claim 15, wherein the liquid formulation further includes about 1% w/w to about 6% w/w of a binding agent.

* * * * *